US007372974B2

(12) United States Patent
Yanagishita et al.

(10) Patent No.: US 7,372,974 B2
(45) Date of Patent: May 13, 2008

(54) HEADPHONE WITH CORD WINDER DEVICES

(75) Inventors: Yuuji Yanagishita, Yokohama (JP); Masaaki Tanaka, Yokohama (JP); Fumio Usui, Sagamihara (JP); Tatsuro Shirai, Maebashi (JP)

(73) Assignee: Victor Company of Japan, Limited, Yokohama (JP)

( * ) Notice: Subject to any disclaimer, the term of this patent is extended or adjusted under 35 U.S.C. 154(b) by 683 days.

(21) Appl. No.: 10/934,726

(22) Filed: Sep. 7, 2004

(65) Prior Publication Data

US 2005/0058316 A1 Mar. 17, 2005

(30) Foreign Application Priority Data

Sep. 12, 2003 (JP) ..... P2003-321215
Apr. 23, 2004 (JP) ..... P2004-128500

(51) Int. Cl.
*H04R 25/00* (2006.01)

(52) U.S. Cl. ..... 381/384; 381/370

(58) Field of Classification Search ..... 381/370–371, 381/373–374, 380–384
See application file for complete search history.

(56) References Cited

U.S. PATENT DOCUMENTS 6,480,611 B2 * 11/2002 Hashimoto et al. ..... 381/371
6,728,388 B1 * 4/2004 Nageno et al. ..... 381/381
7,184,565 B2 * 2/2007 Ohta ..... 381/384

FOREIGN PATENT DOCUMENTS

JP 2002-010385 1/2002

OTHER PUBLICATIONS

Commercial Catalog published Sep. 9, 2003 in Japan for Victor, JVC.

* cited by examiner

*Primary Examiner*—Suhan Ni
(74) *Attorney, Agent, or Firm*—The Nath Law Group; Jerald L. Meyer; Matthew J. Moffa

(57) ABSTRACT

The present invention provides a headphone with cord winder devices that are capable of winding up a bridging cord between one (left) headphone assembly and the other (right) headphone assembly. The headphone comprises one (left) headphone assembly accommodating, in one (left) headphone housing corresponding to one of the left and right ear, a speaker and a cord winder device for winding up an input cord for connecting to audio-video equipment; and the other (right) headphone assembly accommodating, in the other (right) headphone housing corresponding to the other of the left and right ear, a speaker and a cord winder device for winding up a bridging cord for bridging the left headphone housing and the right headphone housing.

5 Claims, 18 Drawing Sheets

HEADPHONE WITH CORD WINDER DEVICES

BACKGROUND OF THE INVENTION

1. Field of the Invention

The present invention relates to a headphone with a cord winder device comprising a right-and-left pair of headphone assemblies accommodating in a respective right-and-left pair of headphone housings a respective right-and-left pair of small speakers for converting stereo audio signals from audio-video equipment into sound and a respective right-and-left pair of cord winder devices, one for winding up an input cord for connecting to the apparatus and the other for winding up a bridging cord for bridging a right-and-left pair of headphone housings.

2. Description of the Related Art

Typically, a headphone is composed of a pair of headphone assemblies configured in a way that stereo audio signals are inputted from audio video equipment such as an MD (Mini Disc) player, a portable CD (Compact Disc) player, and a portable LCD (Liquid Crystal Display) display device to one of a right-and-left pair of headphone housings through an input cord and to the other of the headphone housings through a bridging cord, thereby converting the stereo signals into stereo sound to convey to user's ears by small-sized speakers accommodated in a right-and-left pair of headphone housings. Many of such headphones widely available are of a clip-on type without a headband.

As an example of such a clip-on type headphone, there has been developed a headphone with a cord winder device, as seen in Japanese Patent Application Laid-open Publication 2002-10385, wherein the input cord for connecting to audio-video equipment can be wound up into the cord winder device accommodated in a headphone housing and an input plug attached at the distal end of the input cord can be housed into the same headphone housing.

A headphone 100 with a cord winder device of the related art illustrated in FIGS. 1 through 3 is the headphone disclosed in the above patent publication, the headphone being explained briefly below in reference to the publication.

Firstly, the headphone 100 with a cord winder device comprises a right-and-left pair of headphone assemblies 101L, 101R that are configured substantially into a right-and-left symmetry in accordance with a user's right-and-left ears as shown in FIG. 1.

Specifically, the right-and-left pair of headphone assemblies 101L, 101R are configured by accommodating a pair of small speakers (not shown) symmetrically in a right-and-left pair of headphone housings 102L, 102R, which form the exterior of the headphone assemblies; accommodating a winder device (not shown) in only the left headphone housing 102L; and mounting a right-and-left pair of ear hooks 103L, 103R respectively on the outer surface of the right-and-left pair of headphone housings 102L, 102R.

When the headphone 100 with a cord winder device of the related art is put into use, the right-and-left headphone assemblies 101L, 101R are worn on the user's right and left ears with the right-and-left pair of ear hooks 103L, 103R, respectively.

The headphone assembly 101L is provided with an input cord 105 having at the distal end thereof an input plug 104 for electrically connecting to audio-video equipment. The input cord 105 can be wound up into the winder device (not shown) accommodated in the left headphone housing 102L. By plugging the input plug 104 into the audio-video equipment, stereo audio signals outputted from the equipment are inputted into the left headphone assembly 101L through the input cord 105. Then, audio signals for the left channel of the stereo signals inputted into the left headphone assembly 101L are converted to sound and conveyed toward the user's left ear by the small speaker (not shown) accommodated in the left headphone assembly 101L.

On the other hand, a bridging cord 106 is connected from the left headphone assembly 101L to the right headphone 101R. It is through the bridging cord 106 that audio signals for the right channel are transmitted to the right headphone 101R and then converted to sound and conveyed toward the user's right ear by the small speaker (not shown) accommodated in the right headphone housing 102R. The bridging cord 106 is provided slidably with a slider 107 for adjusting a loose length of the bridging cord 105 by bundling the cord 106 into a U-shape.

As stated above, when the headphone 100 with a cord winder device is in use, the input cord 105 provided in the left headphone assembly 101L is pulled out from the left headphone housing 102L and the input plug 104 attached at the distal end of the input cord 105 is plugged in the audio-video equipment, as shown in FIG. 2.

When the headphone 100 with a cord winder device is not in use, the input cord 105 provided in the left headphone assembly 101L is wound up into the left headphone housing 102L and the end of input plug 104 attached at the distal end of the input cord 105 is inserted into an accommodating hole of a projection portion 102La that is formed protrusively and integrally on the left headphone housing 102L, as shown in FIG. 3.

On the other hand, the bridging cord 106 is unwound and bundled in a U shape with the slider 107.

As explained, in the headphone 100 with a cord winder device, while the left headphone housing 102L accommodates a small speaker (not shown) for conveying left sound and the cord winder device (not shown) for winding up the input cord 105 for connecting to audio-video equipment, the right headphone housing 102R accommodates only a small speaker (not shown) for conveying right sound.

With this configuration, when the headphone 100 with a cord winder device is not in use, while the input cord 105 is wound up into the left headphone housing 102L, the bridging cord 106 remains unwound between the left and right headphone housings 102L, 102R as shown in FIG. 3. So, it is annoying for a user to handle the unwound bridging cord 106. Also, the unwound bridging cord 100 deteriorates the appearance of the headphone 100.

Furthermore, with the above configuration, since the right headphone housing 102R has a hollow space therein due to the absence of a cord winder device, whereas the left headphone housing 102L accommodates the device, the right headphone housing 102R exhibits different sound properties from those in the left headphone housing 102L. This is because part of the sound produced by the right speaker in the right headphone housing 102R reverberates differently from the sound produced by the left speaker in the left headphone housing 102L when the headphone 100 with a cord winder device is in use. So, such a configuration causes a problem in that the stereo audio signals cannot be converted into sound with balanced quality.

Therefore, there has been expected a headphone with cord winder devices in which an input cord for connecting to audio-video equipment can be wound up into one headphone assembly and a bridging cord between the headphone assemblies can be wound up into the other, thereby providing the balanced sound properties by accommodating both the small speaker and the cord winder device in each headphone assembly and thereby producing stereo sound with balanced quality.

SUMMARY OF THE INVENTION

The present invention has been made in the light of the above circumstances. According to a first aspect of the present invention, there is provided a headphone with cord winder devices, comprising a first headphone assembly accommodating, in a first headphone housing corresponding to one of the left and right ears, a speaker and a cord winder device for winding up an input cord for connecting to audio-video equipment; and a second headphone assembly accommodating, in a second headphone housing corresponding to the other of the left and right ears, a speaker and a cord winder device for winding up a bridging cord for bridging said first headphone housing and said second headphone housing.

According to a second aspect of the present invention, there is provided a headphone with cord winder devices according to the first aspect, comprising a first projection protruding integrally from the exterior of said first headphone housing and having a hole formed there inside; a first reel lock lever that pivots around an axis and has, on one end thereof, a catch for locking a winder reel of said cord winder device accommodated in said first headphone housing and a reel lock cancellation portion on the other end thereof with respect to said axis; a first torsion spring for biasing said catch of said first reel lock lever in a direction so as to lock said winder reel and allowing said reel lock cancellation portion to enter said hole formed in said first projection; a second projection protruding integrally from the exterior of said second headphone housing and having a hole formed there inside; a second reel lock lever that pivots around an axis and has, on one end thereof, a catch for locking a winder reel of said cord winder device accommodated in said second headphone housing and a reel lock cancellation portion on the other end thereof with respect to said axis; a cam pin that moves forward and backward in said hole formed in said second projection and has a tapered cam portion for pivoting said reel lock cancellation portion of said second reel lock lever in a direction so as to unlock said winder reel; a compression spring for biasing one end portion of said cam pin to protrude out from said hole formed in said second projection; a second torsion spring for biasing said catch of said second reel lock lever in a direction so as to lock said winder reel and allowing said reel lock cancellation portion to enter the vicinity of said tapered cam portion formed in said cam pin in said hole formed in said second projection, wherein when an input plug attached on the distal end of said input cord is inserted into said hole formed in said first projection, said input plug pushes said reel lock cancellation portion of said first reel lock lever against said first torsion spring and unlocks an engagement of said catch onto said winder reel, thereby winding up said input cord into said cord winder device accommodated in said first headphone housing, and when said cam pin is pushed into said hole formed in said second projection against said compression spring, said tapered cam portion formed in said cam pin pushes said reel lock cancellation portion of said second reel lock lever against said second torsion spring and unlocks an engagement of said catch onto said winder reel, thereby winding up said bridging cord into said cord winder device accommodated in said second headphone housing.

According to a third aspect of the present invention, there is provided a headphone with cord winder devices according to the first aspect comprising, a first projection protruding integrally from the exterior of said first headphone housing, having a extrusion pin formed protrusively from the exterior surface thereof and a hole formed thereinside; a first reel lock lever that pivots around an axis and has on one end thereof a catch for locking a winder reel of said cord winder device accommodated in said first headphone housing and a reel lock cancellation portion on the other end thereof with respect to said axis; a first torsion spring for biasing said catch of said first reel lock lever in a direction so as to lock said winder reel and allowing said reel lock cancellation portion to enter said hole formed in said first projection; a second projection protruding integrally from the exterior of said second headphone housing and having a hole formed thereinside; a second reel lock lever that pivots around an axis and has, on one end, thereof a catch for locking a winder reel of said cord winder device accommodated in said second headphone housing and a reel lock cancellation portion on the other end thereof with respect to said axis; a second torsion spring for biasing said catch of said second reel lock lever in a direction so as to lock said winder reel and allowing said reel lock cancellation portion to enter said hole formed in said second projection, wherein when an input plug attached on the distal end of said input cord is inserted into said hole formed in said first protrusion, said input plug pushes said reel lock cancellation portion of said reel lock lever against said first torsion spring and unlocks an engagement of said catch onto said winder reel, thereby winding up said input cord into said cord winder device accommodated in said first headphone housing, and when said extrusion pin formed protrusively from the exterior surface of said first projection is inserted into said hole formed in said second protrusion, said extrusion pin pushes said reel lock cancellation portion of said second reel lock lever against said second torsion spring and unlocks an engagement of said catch onto said winder reel, thereby winding up said bridging cord into said cord winder device accommodated in said second headphone housing.

According to a fourth aspect of the present invention, there is provided a headphone with cord winder devices according to the second and third aspect, wherein when said input cord is wound up into said first headphone housing, a plug sleeve formed to have a predetermined diameter at the front edge of said input plug or a salient portion protrusively formed to have a predetermined diameter on the mold-formed portion of said input plug is inserted into said hole formed in said first projection.

According to a fifth aspect of the present invention, there is provided a headphone with cord winder devices comprising a right-and-left pair of headphone assemblies configured by confronting and combining respectively a right-and-left pair of inner frame bodies, each of which accommodates a speaker and is to be worn on user's ears, and a right-and-left pair of outer frame bodies, each of which accommodates a cord winder device and is to be worn on user's ears with the inner frame body in-between under an acoustically isolated condition, wherein there is formed an air-discharging hole for ventilating out the air behind said speaker on each of said right-and-left pair of inner frame bodies.

In the headphone with cord winder devices according to the first aspect of the present invention, since the input cord and the bridging cord are wound up respectively into a right-and-left pair of cord winder devices that are respectively accommodated in a right-and-left pair of headphone housings when the headphone is not in use, both cords can be neatly handled producing a tidy appearance. Also, since each of the right-and-left pair of headphone assemblies accommodates the speaker and the cord winder device, many parts of the right-and-left pair of headphone housings can be commonly used for manufacturing the headphone assembly. Furthermore, both headphone assemblies have the same configuration, thereby realizing the same sound properties between the assemblies and thereby producing stereo sound with balanced sound quality.

In the headphone with cord winder devices according to the second aspect of the present invention, particularly when the input plug attached at the distal end of the input cord is inserted into a hole formed in one projection, the plug pushes the reel lock cancellation portion of one reel lock lever against the force exerted by one torsion spring to release the locking of the lock portion onto the winder reel, thereby winding up the input cord into the cord winder device accommodated in one headphone housing. Furthermore, when the cam pin is depressed into a hole formed in the other projection against the force exerted by a compression spring, the tapered cam portion pushes the reel lock cancellation portion of the other reel lock lever against the other torsion spring to release the locking of the lock portion onto the winder reel, thereby winding up the bridging cord into the cord winder device accommodated in the other headphone housing. With this configuration, the input cord and the bridging cord are securely wound up.

According to the third aspect of the present invention, particularly when the input plug attached at the distal end of the input cord is inserted into a hole formed in one projection, the plug pushes the reel lock cancellation portion of one reel lock lever against the force exerted by one torsion spring to release the locking of the lock portion onto the winder reel, thereby winding up the input cord into the cord winder device accommodated in one headphone housing. Furthermore, when the extrusion pin protrusively formed on the outer surface of one projection is inserted into the hole formed in the other protrusion portion, the extrusion pin pushes the reel lock cancellation portion of the other reel lock lever against the force exerted by the other torsion spring to release the locking of the lock portion onto the winder reel, thereby winding up the bridging cord into the other cord winder device accommodated in the other headphone housing. Therefore, unless the right and left headphone assemblies are removed from the user's ears, the bridging cord can not be wound up into the other headphone housing, thereby preventing the bridging cord from getting caught around the user's neck. Moreover, since there is not at all a problem in that the other headphone assembly is removed from the user's ear by the winding force, the safety and usability regarding a headphone with cord winder devices are improved.

According to the fourth aspect of the present invention, when the input cord is wound up into one headphone housing, a plug sleeve having a predetermined diameter formed at the end of the input plug, or a salient portion having a predetermined diameter formed at the mold-formed portion of the input plug, is inserted into the hole formed in the other projection. Therefore, particularly when the salient portion of the input plug is inserted into the hole formed in the other projection, the input cord can be wound up while the input sleeve of the input plug remains inserted in the audio-video equipment.

According to the fifth aspect of the present invention, the right-and-left pair of headphone assemblies are configured by confronting and then combining a right-and-left pair of inner frame bodies, which respectively accommodate a speaker and are to be positioned on the ear side, and a right-and-left pair of outer frame bodies, which respectively accommodate a cord winder, under an acoustically isolated condition. Since each of the right-and-left pair of inner frames is provided with an air vent hole for discharging the air behind the speaker so that the air can be ventilated through the hole, reverberation within an inner frame body can be avoided, thereby producing high fidelity sound from the speaker. In addition, since the right and left inner frame bodies are formed into the same configuration, and so are the right and left outer frame bodies, the same acoustic conditions for the speakers are realized between the right and left headphone assemblies, thereby obtaining balanced sound properties in both assemblies.

DESCRIPTION OF THE PREFERRED EMBODIMENTS

Referring to FIGS. 4 through 18, a headphone with cord winder devices according to embodiments of the present invention will be described in detail below.

A headphone with cord winder devices according to the present invention is characterized in that the headphone comprises a first headphone assembly accommodating a speaker and a cord winder device for winding up an input cord for connecting to audio-video equipment into a first housing for one of the right and left ear, and a second headphone assembly accommodating a speaker and a cord winder for winding up a bridging cord for bridging said first headphone assembly and said second assembly into a second housing for the other of the right and left ear. While the headphone assembly for the left ear accommodates the cord winder device for winding up the input cord in a first and second embodiment below and the headphone assembly for the right ear accommodates the cord winder device for winding up the bridging cord, the opposite configuration is obviously possible.

Moreover, in the first and second embodiment below, the technical idea behind the present invention of a headphone with cord winder devices is exemplified into a clip-on type headphone in which a pair of headphone housings defining an exterior of a right-and-left pair of headphone assemblies are provided with a right-and-left pair of ear hooks, respectively. However, without limiting to this type, the present invention is applicable to a headband type headphone in which right-and-left pair of headphone assemblies are connected with each other with a headband, though not illustrated here.

First Embodiment

Figure 1:
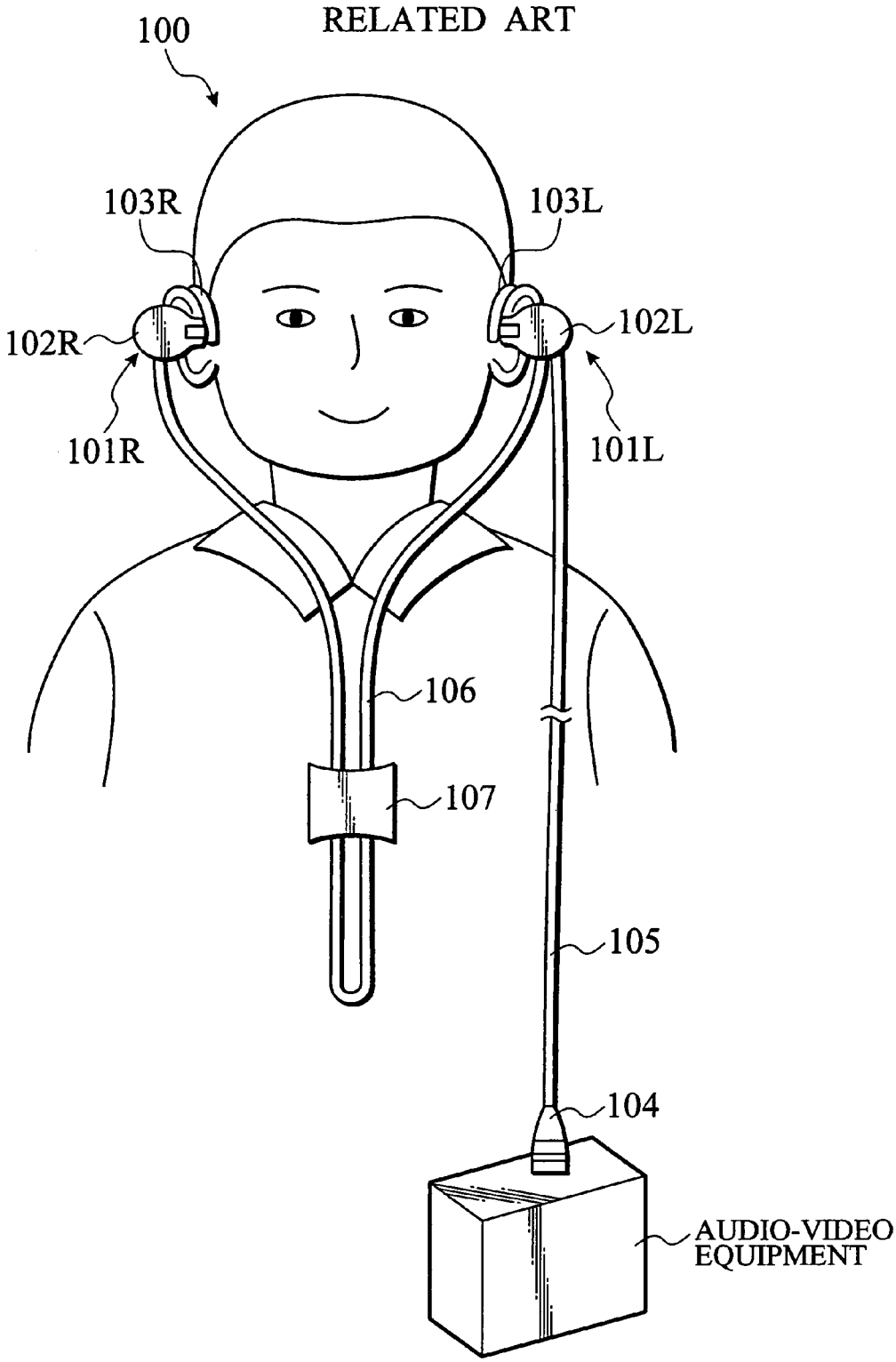
FIG.1 RELATED ART
FIG. 1 is an explanatory drawing to show a related-art headphone with cord winder devices in use, that is, when each headphone housing is worn on the user's ear.
Figure 2:
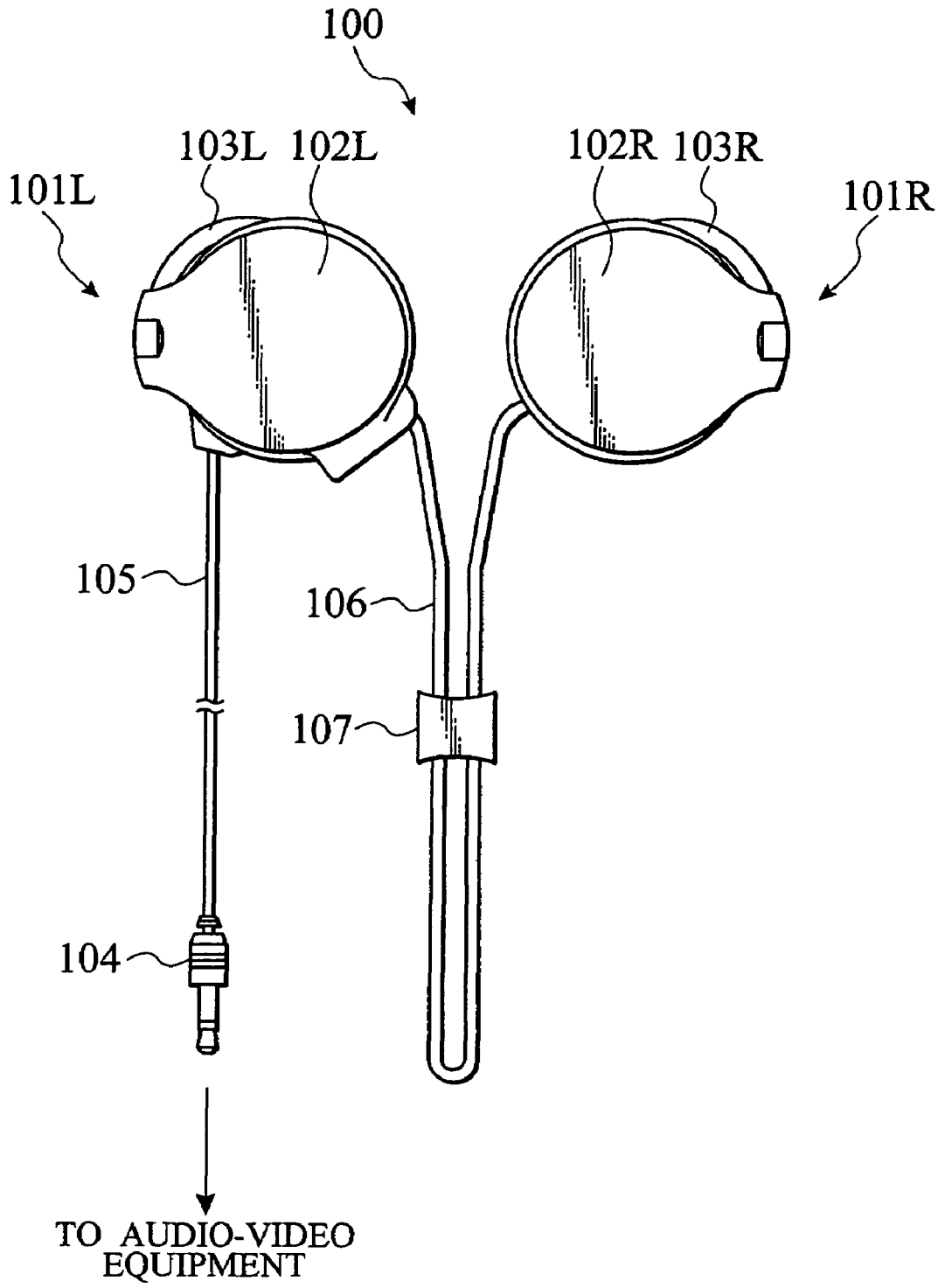
FIG.2 RELATED ART
FIG. 2 is an illustration to show the headphone with cord winder devices when the input cord is pulled out from the winder device in use.
Figure 3:
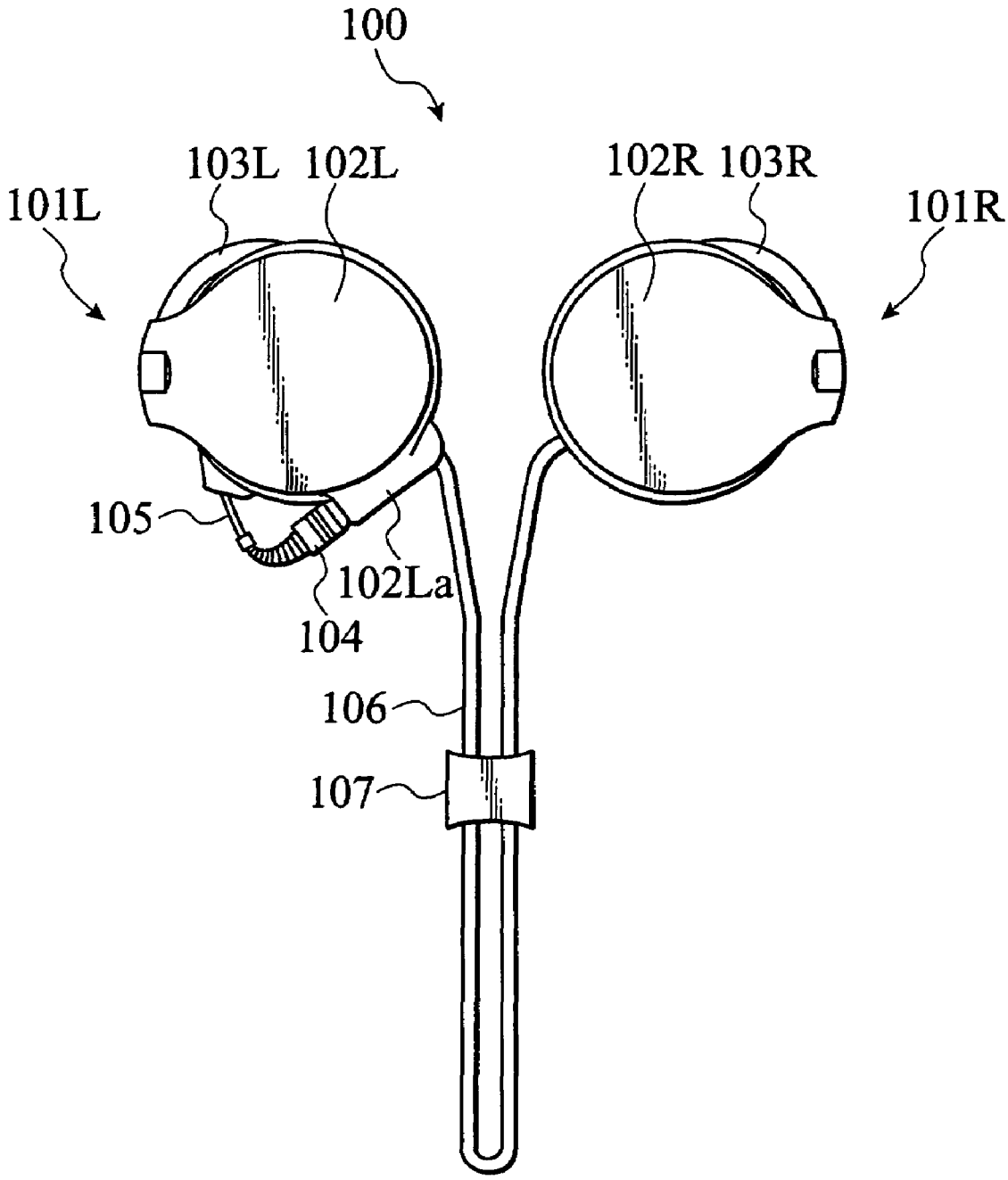
FIG.3 RELATED ART
FIG. 3 is an illustration to show the headphone with cord winder devices when the input cord is wound up into the winder device not in use.
Figure 4:
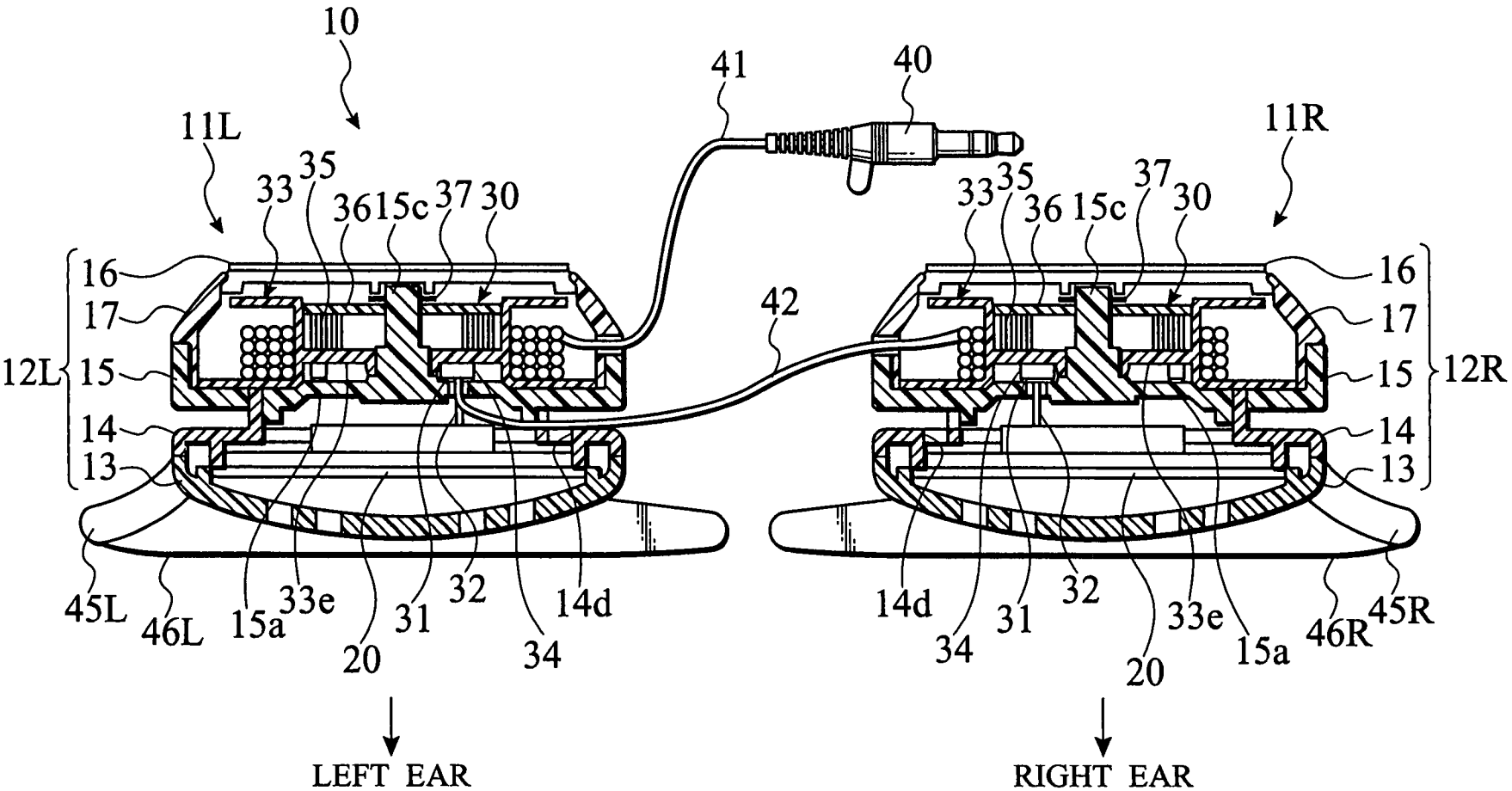
FIG. 4 is a cross-sectional view of a headphone with cord winder devices according to a first embodiment of the present invention.

As shown in FIG. 4, a headphone 10 with cord winder devices according to a first embodiment of the present invention is composed substantially symmetrically of the right-and-left pair of headphone assemblies 11L, 11R that correspond to user's right and left ears, respectively.

The right-and-left pair of headphone assemblies 11L, 11R accommodate a pair of small speakers 20, 20 for converting stereo signals into right and left sound, respectively, the signals being outputted from audio-video equipment through an input cord 41 having an input plug 40 attached at the distal end thereof, and a pair of cord winder devices 30, 30 for winding up the input cord 41 and a bridging cord 42 for bridging the right-and-left pair of headphone housings 12L, 12R. Also, the right-and-left pair of headphone assemblies 11L, 11R respectively have one end portion of each of a right-and-left pair of ear hooks 45L, 45R attached at the outer portion thereof.

The right-and-left pair of headphone housings 12L, 12R are constructed by combining a first to a fifth frame body 13 to 17, the configuration of which will be described in detail later.

The input cord 41 is about 1,000 mm long and the bridging cord 42 is about 550 mm long in this embodiment.

The right-and-left pair of ear hooks 45L, 45R symmetrically have a right-and-left pair of ear hook pads 46L, 46R, formed with a flexible resin material, embedded at each end thereof, thereby providing a comfortable touch to the user's ears.

Figure 5:
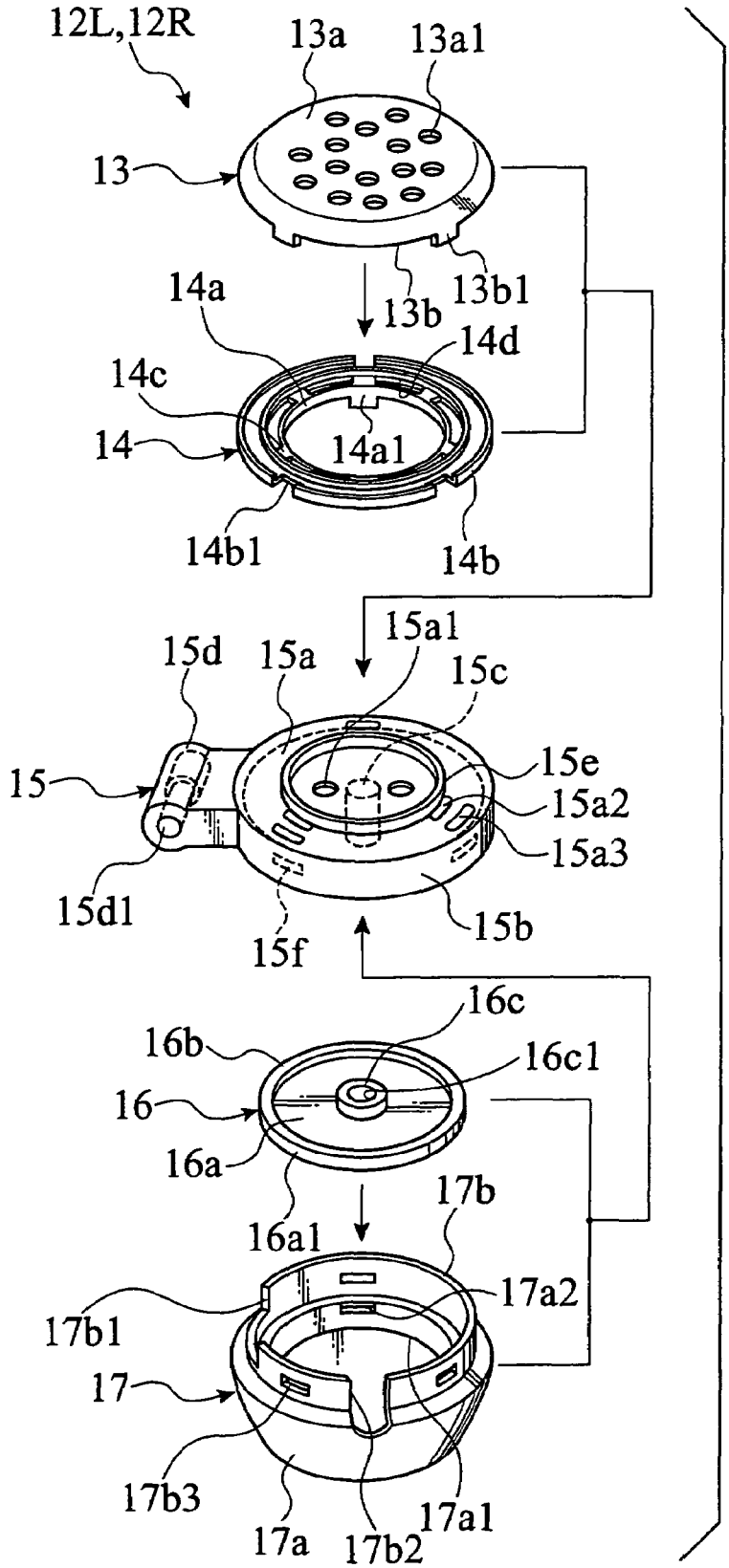
FIG. 5 is an exploded perspective view of a right-and-left pair of headphone housings shown in FIG. 4.

As shown in the exploded view of FIG. 5, the right-and-left pair of headphone housings 12L, 12R are commonly constructed by combining a total of five members, that is, the first to fifth frame bodies 13 to 17 formed of an electrically insulating resin material and also the housings 12L, 12R can be used for the right and left headphone assemblies.

Among the first to fifth frame bodies 13 to 17, the first and second frame bodies 13, 14 are formed into an inner frame body, which is to be worn on a user's ear, for accommodating the small speaker 20 (FIG. 4) and the third to fifth frame bodies 15 to 17 are formed into an outer frame body, which is to be worn on a user's ear with the inner frame body in-between, for accommodating the cord winder device 30 (FIG. 4). The right and left headphone housings 12R, 12L are constructed by confronting and then combining the inner frame body (13, 14) and the outer frame body (15, 16, 17) with each other under an acoustically isolated condition.

The first to fifth frame bodies 13 to 17 will be more particularly described now. Firstly, the first frame body 13 formed into a cup shape is provided with a plural of round holes 13*a*1 for allowing the sound converted by the small speaker 20 (FIG. 4) to transmit to the user's ear, at the upper surface 13*a* thereof. Also, the upper surface 13*a* of the first frame body 13 is covered with a soft ear pad (not shown) that softly contacts the user's ear. In addition, on the reverse surface 13*b* of the first frame body 13, three catches 13*b*1 extending downward for combining the first and second bodies 13, 14 are formed at angular intervals of about 120 degrees along the circumference thereof.

The second frame body 14 formed into a ring shape is constructed by connecting an inner ring portion 14*a* and an outer ring portion 14*b* using 6 stay portions 14*c* disposed at angular intervals of about 60 degrees. Between the upper face of the second frame body 14 and the first frame body 13, the speaker 20 (FIG. 4) can be accommodated. In addition, between the inner and outer ring portions 14*a*, 14*b* of the second frame body 14 and also between neighboring stay portions 14*c*, six air-discharging holes 14*d* are formed piercing the second frame body 14. Through these 6 holes 14*d*, the air behind the small speaker 20 can be ventilated out.

In addition, at the lower portion of the inner ring portion 14*a* of the second frame body 14, three catches 14*a*1 are formed extending downward at angular intervals of about 120 degrees, the catches 14*a*1 being used to attach the second frame body 14 with the third frame 15 described below. Moreover, in the outer ring portion 14*b* of the second frame body 14, three notches 14*b*1 are formed into a concave shape at angular intervals of about 120 degrees along the periphery thereof. The three catches 13*b*1 formed on the first frame body 13 are detachably engaged with these notches 14*b*1.

After the small speaker 20 (FIG. 4) is accommodated between the first frame body 13 and the second frame body 14, by engaging the three catches 13*b*1 formed on the first frame body 13 with the three notches 14*b*1 formed on the second frame body 14, these two bodies 13, 14 are combined into an inner frame body to be worn on the user's ear.

In the third frame body 15, a ring-shaped circumferential portion 15*b* is formed extending downward along the circumference of a disk portion 15*a*, the ring-shaped circumferential portion 15*b* presenting substantially a tubular shape. Also, an axis portion 15*c*, surrounded by the ring-shaped circumferential portion 15*b*, is formed integrally with the disk portion 15*a*, extending downward from the disk portion 15*a* in the center of the backside of the disk portion 15*a*. In the inside space between the ring-shaped circumferential portion 15*b* and the axis portion 15*c*, the cord winder device 30 (FIG. 4) can be accommodated so as to surround the axis portion 15*c*.

In addition, at the vicinity of the axis portion 15*c* on the disk portion 15*a* of the third frame body 15, there is formed a wire hole 15*a*1 penetrating the disk portion 15*a*. The wire hole 15*a*1 is formed for allowing a wire 32 (FIGS. 4 and 6) soldered onto a wiring substrate 31 (FIGS. 4 and 6) to pass therethrough and eventually covered with the substrate 31 that is to be attached on the backside face of the disk portion 15*a* inside the third frame body 15 as described below.

Furthermore, from an outer portion of the ring-shaped circumferential portion 15*b* of the third frame body 15, there is integrally formed a projection 15*d* in an arm-like shape, and inside of the projection 15*d*, there is formed a stepped hole 15*d*1 having a large and small diameter holes continuously and concentrically.

Into the large diameter portion of the stepped hole 15*d*1, one end of the ear hook 45L for the left ear (or the ear hook 45R for the right ear) (FIG. 4) is inserted and supported therein. Into the small diameter portion of the stepped hole 15*d*1, a plug sleeve 40*a* (FIGS. 7 and 11) or a salient portion 40*d* (FIGS. 7 and 12) of the input plug 40 equipped on the left headphone assembly 11L is detachably inserted as described below. Alternatively, a cam pin 55 (FIG. 8) equipped on the right headphone assembly 11R is movably connected as described below.

On the upper surface of the disk portion 15*a* of the third frame body 15, there is protrusively formed a ring portion 15*e* having a smaller outer diameter than the inner diameter of the inner ring portion 14*a* of the second frame body 14. Also on the upper surface of the disk portion 15*a* and along the outer circumference of the ring portion 15*e*, there are formed three locking holes 15*a*2 at angular intervals of 120 degrees.

When forming the inner frame body with the first and second frame bodies 13, 14, the inner ring portion 14*a* of the second frame body 14 is positioned with the ring portion 15*e* of the third frame body 15 and engaged therewith. The inner frame body (13, 14) is adapted to be combined with the third frame body 15 by engaging the three catches 14*a*1 formed on the second frame body 14 with three locking holes 15*a*2 pierced in the third frame body 15.

Moreover, in the disk portion 15*a* of the third frame body 15 and along the outer circumference thereof, there are penetratingly formed three relief holes 15*a*3 at angular intervals of about 120 degrees. Also, on the inner wall of the ring-shaped circumferential portion 15*b*, there are formed three catches 15*f* to combine with the fifth frame body 17 described below.

Next, in the fourth frame body 16, a peripheral ring-like portion 16*b* having a rather low height is formed along the circumference of the disk portion 16*a* and a small diameter ring portion 16*c* having a rather low height is formed in the center of the disk portion 16*a*, the small diameter ring portion 16*c* having a bottomed hole 16*c*1 into which the tip of the axis portion 15*c* formed in the third frame body 15 can be inserted. Moreover, the outer surface 16*a*1 of the disk portion 16*a* in the fourth frame body 16 is processed to look fancy by metal plating, color printing and the like. After the fourth frame body 16 is inserted into the fifth frame body 17 cup-shaped as described blow, the fourth frame body 16 can be seen through the large diameter hole 17*a*1 formed by cutting out the apex of the cup-shaped frame body 17.

The fifth frame body 17 includes the large diameter hole 17*a*1 that is formed by cutting out the apex of a cup portion 17*a* formed into a cup shape and a ring portion 17*b* formed extending upward from the rim of the cup portion 17*a*, the ring portion 17*b* having a smaller diameter than the maximum diameter of the cup portion 17*a*. On the ring portion 17*b* of the fifth frame body 17 is provided a relief notch 17*b*1 at a position corresponding to the projection 15*d* of the third frame body 15 and a notch 17*b*2 for allowing a cord to pass therethrough at a position away from the relief notch 17*b*1. Along the circumference of the ring portion 17*b* of the fifth frame body 17, three locking holes 17*b*3 at angular intervals of about 120 degrees, the three holes 17*b*3 being adapted to engage with the three catches 15*f* formed on the inner face of the third frame body 15. Also, on and along the inner surface of the cup portion 17*a* of the fifth frame body 17, there are provided three catches 17*a*2 at angular intervals of about 120 degrees, the catches 17*a*2 being adapted to support the ring-shaped circumferential portion 16*b* of the fourth frame body 16 inserted into the cup portion 17*a*.

After the fourth frame body 16 is locked into the fifth frame body 17 and the cord winder device 30 (FIG. 4) is accommodated between the third frame body 15 and the fourth and fifth frame bodies 16, 17, the three catches 15*f* formed on the third frame body 15 are engaged with the three locking holes 17*b*3 formed in the fifth frame body 17, thereby obtaining the outer frame body to be worn on the user's ear via the inner frame body.

The inner frame body (13, 14) and the outer frame body (15 to 17) are confronted under an acoustically isolated conditions and then combined with each other by engaging the three catches 14*a*1 formed on the second frame body 14 and the three locking holes 15*a*2 formed in the third frame body 15. Thus, the headphone housings 12L, 12R (a headphone assembly 11L for the left ear and a headphone assembly 11R for the right ear) are finalized.

The above configuration is shown in the form of a cross-sectional view in FIG. 4. In the right-and-left pair of headphone assemblies 11L, 11R, when the right-and-left pair of headphone housings 12L, 12R are assembled with the first to fifth frame bodies 13 to 17, the small speaker 20 is accommodated between the first frame body 13 and the second frame body 14, and the cord winder device 30 is accommodated between the third frame body 15 and the fourth, fifth frame bodies 16, 17.

For this reason, since the right-and-left pair of headphone assemblies 11L, 11R have the symmetric configuration, the same acoustic conditions are acquired for the small speakers 20, thereby yielding balanced sound properties between the two assemblies.

Furthermore, since the outer frame body (15-17) is shielded with the disk portion 15*a* of the third frame body 15 and the wiring substrate 31 attached onto the disk portion 15*a* in order to prevent the air flow from the inner frame body (13, 14), the inside space of the inner frame body (13, 14) is acoustically isolated from that of the outer frame body (15-17). On the other side, when it comes to the back side of the small speaker 20, since the air inside the inner frame body (13, 14) can flow out through the 6 air-discharging holes 14*d* formed in the second frame body 14, reverberation inside the inner frame body (13, 14) can be prevented, thereby producing high fidelity sound from the assemblies.

In the first embodiment, the right-and-left pair of headphone housings 12L, 12R are configured with the first to fifth frame bodies 13 to 17. However, the number of the frame bodies should not be limited to 5 but changed appropriately as far as the inner frame body accommodating the small speaker 20 is acoustically isolated from the outer frame body accommodating the cord winder device 30.

Figure 6:
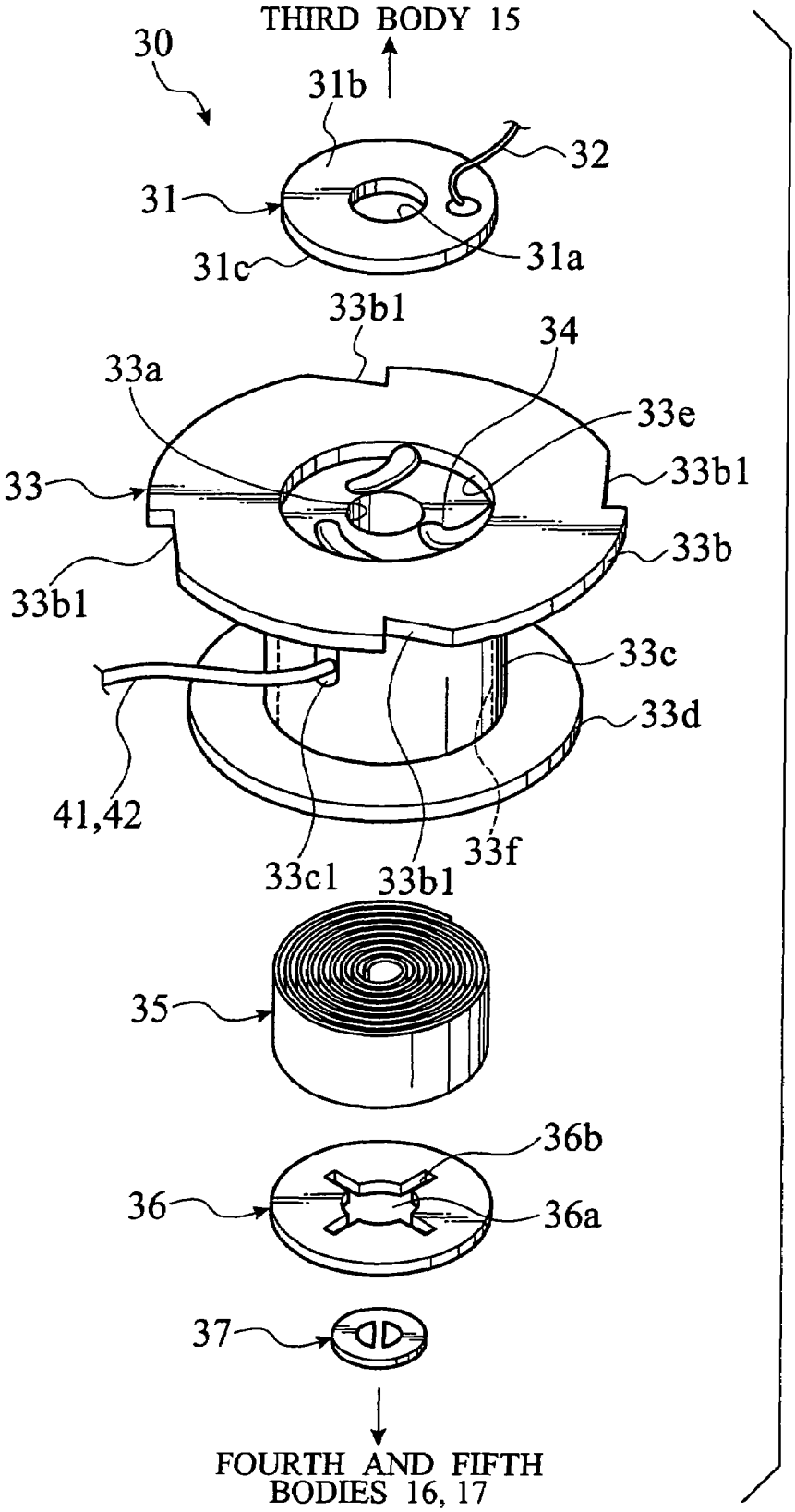
FIG. 6 is an exploded perspective view of a cord winder device shown in FIG. 4.

Next, referring to FIGS. 4, 5 and 6, the cord winder device 30 accommodated between the third frame body 13 and the fourth, fifth frame bodies 16, 17.

As shown in the exploded view of FIG. 6, the above-mentioned cord winder device 30 is assembled with the wiring substrate 31, a winder reel 33, a spiral spring 35, a spiral spring retainer plate 36, and a reel retainer plate 37 in this order from the third frame body 15 to the fifth frame body 17, which have already been explained with reference to FIG. 5, in a way that these members concentrically surround the axis portion 15*c* formed in the ring-shaped circumferential portion 15*b* of the third frame body 15.

The wiring substrate 31 is formed of an electrically insulating resin into a shape of an annular disk having a center hole 31*a* to be engaged with the base portion of the axis portion 15*c* formed in the third frame body 15. The outer diameter of the wiring substrate 31 is slightly smaller than the inner diameter of a first circular recess portion 33*e* formed in the winder reel 33 described blow. The wiring substrate 31 is intended to be positioned with respect to the axis portion 15*c* in the center portion of the inner surface of the disk portion 15*a* inside the ring-shaped circumferential portion 15*b* of the third frame body 15 and secured therein by attaching the surface 31*b* onto the inner surface of the disk portion 15*a*. One end of the wire 32 is soldered onto the wiring substrate 31 and the other end is drawn through the wire hole 15*a*1 made in the disk portion 15*a* of the third frame body 15 toward the small speaker 20. On a surface 31*c* of the wiring substrate 31, which is opposite to the surface 31*b*, a plural of electrically conductive ring-shaped wiring patterns (not shown) having different diameters are formed concentrically with respect to the center hole 31*a*. To these wiring patterns are slidably contacted a plural of electrically conductive brushes 34 formed inside the first recess portion 33*e* of the winder reel 33.

Meanwhile, as shown only in FIG. 4, in the left headphone assembly 11L, one end of the bridging cord 42 is soldered onto the surface 31*b* of the wiring substrate 31 and the other end of the bridging cord 42 is drawn through the wire hole 15*a*1 made in the disk portion 15*a* of the third frame body 15 toward the cord winder reel 33 of the right headphone assembly 11R.

Next, the winder reel 33 is composed integrally of a large diameter reel flange portion 33*b*, a reel boss portion 33*c*, both of which are intended to be positioned on the side of the third frame body 15, and a small diameter flange portion 33*d*, which is intended to be positioned on the side of the fourth and fifth frame bodies 16, 17, with a center hole 33*a* adapted to engage with the axis portion 15*c* formed of an electrically insulating resin material inside the third frame body 15, the winder reel 33 presenting substantially an H shape. The winder reel 33 is capable of winding up the input cord 41 or the bridging cord 42 around the reel boss portion 33*c* formed between the large and small flange portions 33*b*, 33*d*.

In the reel boss 33*c*, the first circular recess portion 33*e* is shallowly formed concentrically with the center hole 33*a* on the side of the large diameter reel flange portion 33*b*. Within the first circular recess 33*e* of the winder reel 33, a plural of electrically conductive brushes 34 are formed of a spring material having an electrical conductivity and elasticity extending from the side wall of the recess portion 33*e* spirally toward the center thereof, the brushes 34 having different lengths. The reel boss portion 33*c* also has a wire hole 33*c*1 formed therein, through which the input cord 41 or the bridging cord 42 is connected with the electrically conductive brushes 34 and then is connected thereto. With these brushes 34 slidably contacting the plural of the ring-shaped wiring patterns (not shown) formed on the surface 31*c* of the wiring substrate 31, audio signals from the input cord 41 or the bridging cord 42 are transmitted to the wiring substrate 31 even when the winder reel is rotating.

The large diameter reel flange portion 33*b* is provided with four reel lock notches 33*b*1 at angular intervals of about 90 degrees along the circumference thereof. A role of these reel lock notches 33*b*1 will be described below along with a right-and-left pair of reel lock mechanism portion 50L, 50R referring to FIGS. 7 and 8.

In the reel boss portion 33*c*, a second circular recess portion 33*f* is deeply formed concentrically with a center hole 33*a* on the side of the small diameter reel flange portion 33*d*. Within the second circular recess 33*f* are fitted the spiral spring 35 and the spiral spring retainer plate 36.

The spiral spring 35 is made of a thin metal sheet wounded up. The spiral spring retainer plate 36 is shaped into substantially an annular disk with a center hole 36*a* to be engaged with the upper end of the axis portion 15*c* formed on the third frame body 15. The spiral spring retainer plate 36 has 4 notches at the inner circumference in order to gain flexibility, the notches presenting a cross shape 36*b* in the whole. Also, the spiral spring retainer plate 36 has an outer diameter slightly smaller than the inner diameter of the second circular recess portion 33*f* of the winder reel 33.

When the spiral spring 35 is engaged into the second circular recess portion 33*f* of the winder reel 33, one end of the spiral spring 35 is secured on the wall of the second circular recess portion 33*f*, while the other end of the spiral spring 35 is securely inserted into a slit (not shown) of the axis portion 15*c* formed inside the third frame body 15. Since the spiral spring retainer plate 36 is disposed over the spiral spring 35, the spiral spring 35 is prevented from leaving out from the recess portion 33*f*. Also, with the spiral spring retainer plate 36 securely fastened to the slit at the upper portion of the axis portion 15*c* formed inside the third frame body 15, the winder reel 33 is prevented from leaving out from the axis portion 15*c*.

The spring force exerted by the spiral spring 35 drives the winder reel 33 to rotate, thereby winding up the input cord 41 or bridging cord 42 around the reel boss portion 33*c* of the winder reel 33.

Figure 7:
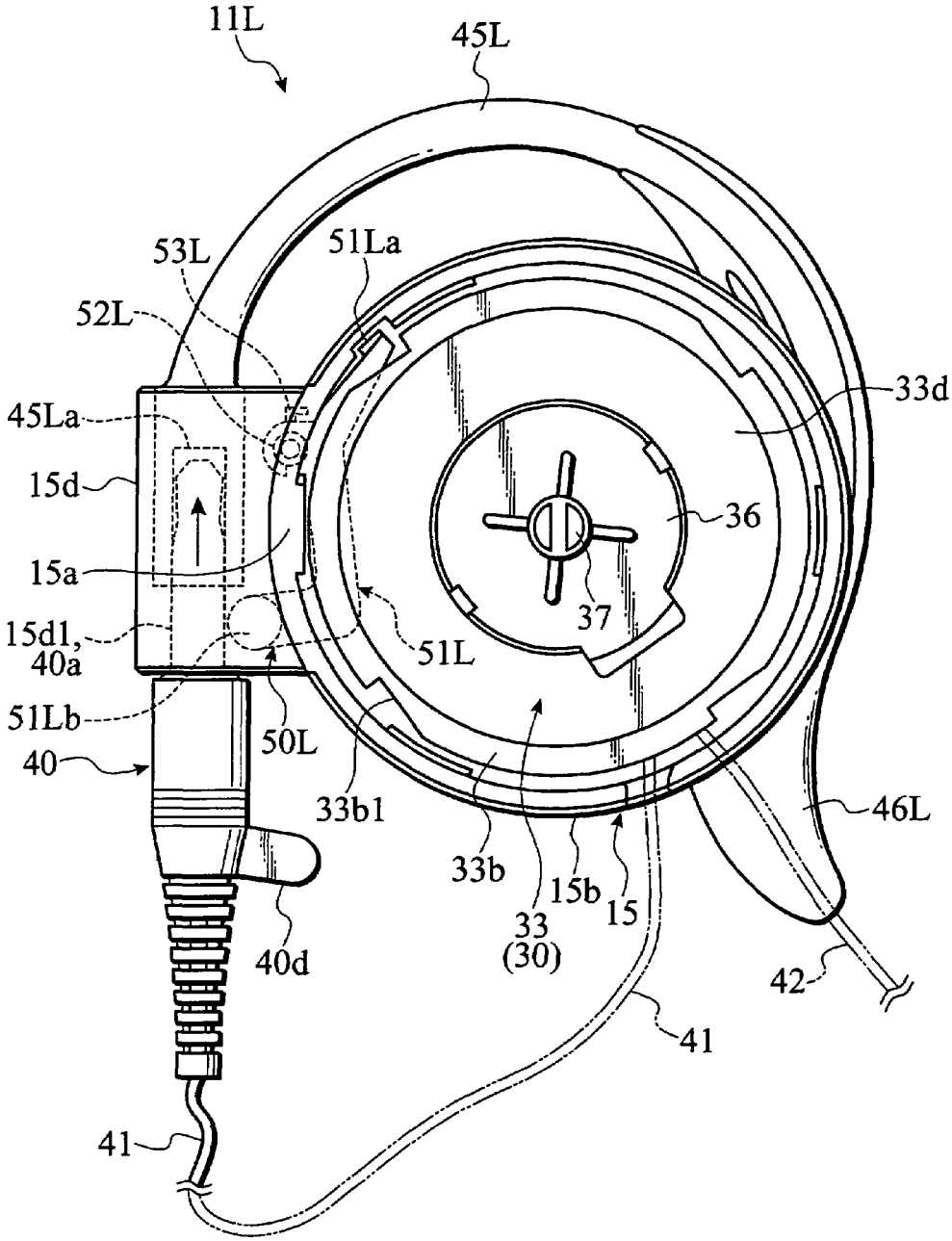
FIG. 7 is a plane view of the left headphone assembly of the headphone with cord winder devices according to the first embodiment of the present invention.
Figure 8:
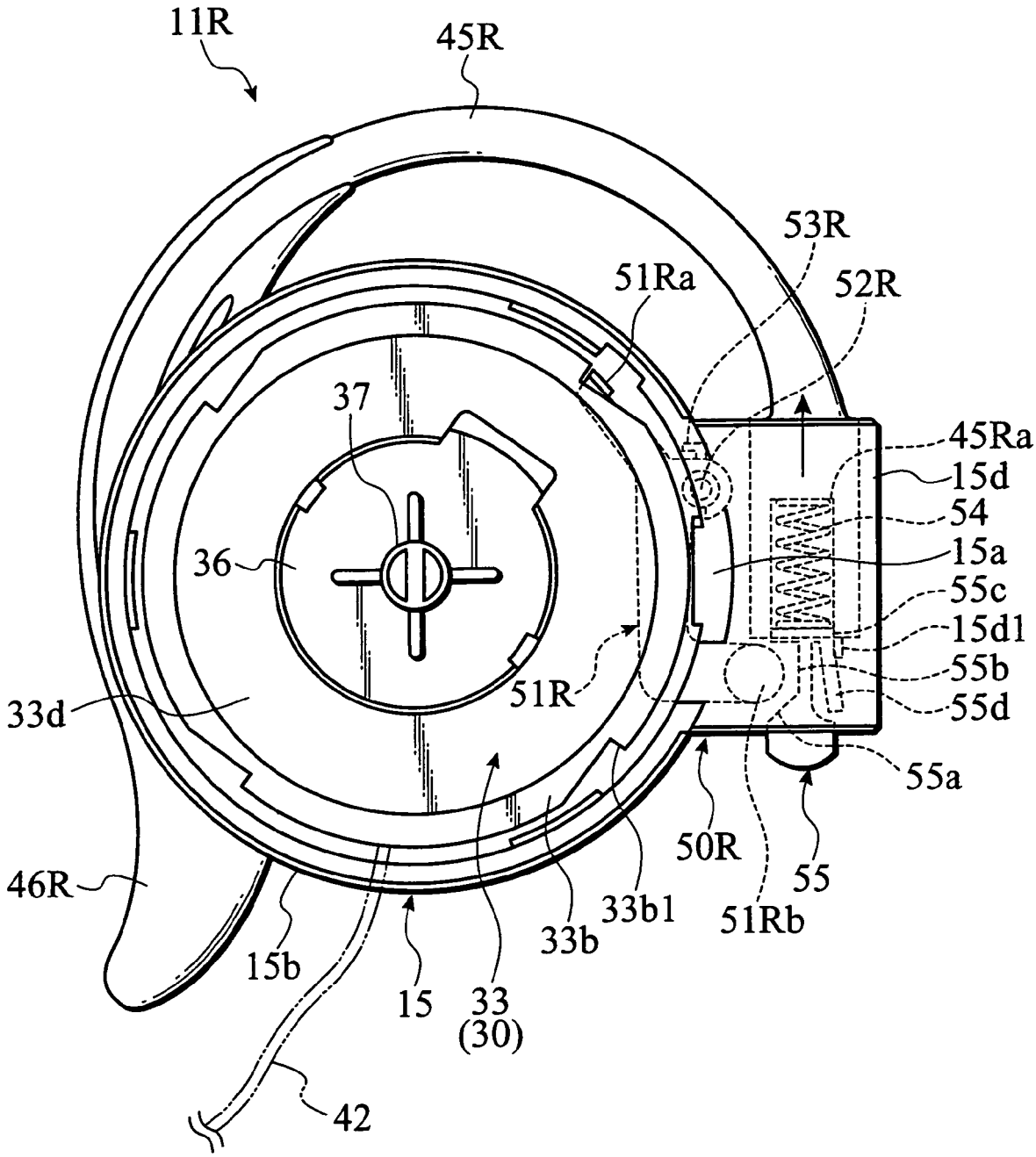
FIG. 8 is a plane view of the right headphone assembly of the headphone with cord winder devices according to the first embodiment of the present invention.

Referring to FIGS. 7 and 8, firstly a reel lock mechanism 50L on the headphone assembly 11L for the left ear and secondly a reel lock mechanism 50R on the headphone assembly 11R for the right ear will be described.

As shown in FIG. 7, in the headphone assembly 11L for the left ear, one end of the left hook 45L is securely inserted into a large diameter hole of the stepped hole 15*d*1 formed in the projection 15*d* of the third frame body 15. On the other end of the ear hook 45L is embedded the ear pad 46L.

When the cord winder device 30 is accommodated on the disk portion 15*a* and inside the ring-shaped circumferential portion 15*b* of the third frame body 15, the reel lock mechanism 50L for the left ear headphone assembly is provided above the disk portion 15*a* on the side of the projection 15*d* protrusively formed from a portion of the outer surface of the peripheral ring-like portion 15*b* and near the peripheral area of the large diameter flange portion 33*b* of the winder reel 33.

In the reel lock mechanism 50L mentioned above, a reel lock lever 51L formed of a steel metal material is provided pivotably around an axis 52L implanted in the disk portion 15*a* and constantly biased clockwise by the force exerted by a torsion spring 53L. The reel lock lever 51L includes a catch 51La formed so as to bend upward on one end thereof. Also, the reel lock lever 51L has a reel lock cancellation portion 51Lb formed with a pin extending upward at the opposite end with respect to the axis 52L.

When the reel lock lever 51L pivots clockwise around the axis 52L by the biasing force exerted by the torsion spring 53L, the catch 51La formed at one end of the reel lock lever 51L comes into an engagement with one of 4 reel lock notches 33*b*1, the notches 33*b*1 being formed along the outer periphery of the large diameter reel flange portion 33*b* of the winder reel 33, thereby locking the winder reel 33. At this time, the reel lock cancellation portion 51Lb enters the smaller diameter portion of the stepped hole 15*d*1 formed inside the projection 15*d* of the third frame body 15, the reel lock cancellation portion 51Lb being implanted using a pin on the other end of the reel lock lever 51L.

In this case, when the winder reel 33 is locked by the reel lock lever 51L, since the winder reel 33 cannot rotate and thereby the input cord 41 cannot be wound up around the winder reel 33.

On the other hand, when the input cord is wound up, the plug sleeve 40*a* formed at the distal end of the input plug 40 having a diameter of 3.5 mm (or the salient portion 40*d*, having a diameter of 3.5 mm, formed on a molded portion of the input plug 40) is inserted into the smaller diameter portion of the stepped hole 15*d*1 formed in the projection 15*d* of the third frame body 15. Upon the insertion of the plug sleeve 40*a* (or the salient portion 40*d*), since the plug sleeve 40*a* (or the salient portion 40*d*) pushes the reel lock cancellation portion 51Lb of the reel lock lever 51L that has entered the smaller diameter portion of the stepped hole 15*d*1, the reel lock lever 51L pivots counterclockwise around the axis 52L against the biasing force exerted by the torsion spring 53L. Then, the catch 51La formed at one end of the reel lock lever 51L is disengaged with the reel lock notch 33*b*1 formed on the large diameter reel flange portion 33*b*, thereby unlocking the winder reel 33. After the winder reel 33 is unlocked, the winder reel 33 begins to rotate counterclockwise by the force exerted by the spiral spring 35 (FIGS. 4 and 6) equipped within the winder reel 33, thereby winding up the input cord 41 around the winder reel 33.

When the plug sleeve 40*a* of the input plug 40 is inserted into the smaller diameter portion of the stepped hole 15*d*1, the tip portion of the plug sleeve 40*a* enters a bottomed hole 45La formed at one end of the ear hook 45L that has been supported by the larger diameter portion of the stepped hole 15*d*1, the bottomed hole 45La having almost the same diameter as the smaller diameter portion of the stepped hole 15*d*1. On the other hand, when the salient portion 40*d* of the input plug 40 is inserted into the smaller diameter portion of the stepped hole 15*d*1, the salient portion 40*d* does not enter the bottomed hole 45La of the ear hook 45L because the salient portion 40*d* is shorter than the plug sleeve 40*a*.

When the input cord 41 that has once been wound up into the winder reel 33 is again pulled out therefrom, firstly, the plug sleeve 40*a* (or the salient portion 40*d*) of the input plug 40 is removed from the small diameter portion of the stepped hole 15*d*1. Upon the removal of the plug sleeve 40*a* (or the salient portion 40*d*), the reel lock lever 51L is biased clockwise onto the large diameter reel flange 33*b* by the biasing force exerted by the torsion spring 53L. However, the reel lock lever 51L does not prevent the clockwise rotation of the winder reel 33 because the reel lock notch 33*b*1 is shaped into a sloped notch so that the catch 51La formed on one end of the reel lock lever 51L can not engage with the reel lock notch 33*b*1 when the winder reel 33 rotates clockwise. Therefore, the input cord 41 comes out only by pulling the input cord 41 out from the winder reel 33.

As shown in FIG. 8, in the headphone assembly 11R for the right ear, one end of the right ear hook 45R is supported by the large diameter hole portion of the stepped hole 15*d*1 formed in the projection 15*d* of the third frame body 15. In the other end of the ear hook 45R is embedded the ear pad 46R.

When the cord winder device 30 is accommodated on the disk portion 15*a* and inside the ring-shaped circumferential portion 15*b* of the third frame body 15, the reel lock mechanism 50R for the right ear headphone assembly is provided above the disk portion 15*a* on the side of the projection 15*d* formed protrusively from a portion of the outer surface of the ring-shaped circumferential portion 15*b* and near the peripheral area of the large diameter flange portion 33*b* of the winder reel 33.

In the reel lock mechanism 50R mentioned above, a reel lock lever 51R formed of a steel metal material is provided pivotably around an axis 52R implanted in the disk portion 15*a* and constantly biased counterclockwise by the force exerted by a torsion spring 53R. The reel lock lever 51R has a catch 51Ra bent upward on one end thereof. Also, the reel lock lever 51R has a reel lock cancellation portion 51Rb formed with a pin extending upward at the opposite end with respect to the axis 52R.

There is formed a bottomed hole 45Ra having substantially the same diameter as the small diameter portion of the stepped hole 15*d*1 in one end of the right ear hook 45R engaged into the large diameter portion of the stepped hole 15*d*1 formed inside the projection 15*d* of the third frame body 15. Into this bottomed hole 45Ra is inserted a compression spring 54. Also, in the small diameter portion of the stepped hole 15*d*1 is housed slidably a cam pin 55 that is pressed by the compression spring 54 but prevented from leaving out.

One end portion of the above mentioned cam pin 55 appears outside. In the small diameter portion of the stepped hole 15*d*1, there is formed a trapezoidal recess portion defined with a tapered cam portion 55*a* that tapers from one end of the cam pin 55 toward the compression spring 54, a low plateau portion 55*b* connecting to the tapered cam portion 55*a*, and a pressed wall portion 55*c* connecting to the low plateau portion 55*b*. Since, a reel lock cancellation portion 51Rb implanted in the other end portion of the reel lock lever 51R using a pin enters the trapezoidal recess portion (55*a*, 55*b*, 55*c*) and thereby prevents the cam pin 55 from leaving out from the small diameter portion of the stepped hole 15*d*1. Within the small diameter portion of the stepped hole 15*d*1, a leaf spring portion 55*d* is provided so as to be directed from the pressed wall 55*c* toward one end portion of the cam pin 55.

When the reel lock lever 51R pivots counterclockwise around the axis 52R by the biasing force exerted by the torsion spring 53R, the catch 51Ra formed on one end of the reel lock lever 51R comes into an engagement with one of four reel lock notch 33*b*1 formed along the circumference of the large diameter reel flange 33*b* of the winder reel 33 at angular intervals of about 90 degrees, thereby locking the winder reel 33. At this time, the reel lock cancellation portion 51Rb implanted in the other end of reel lock lever 51R using a pin enters the trapezoidal recess (55*a* to 55*c*) formed at the cam pin 55 in the small diameter portion of the stepped hole 15*d*1 formed inside the projection 15*d* of the third frame body 15. In other word, the reel lock cancellation portion 51Rb implanted in the other end of the reel lock lever 51R using a pin enters close to the tapered cam portion 55*a*.

At this time, when the winder reel 33 is locked by the reel lock lever 51R, the reel 33 cannot rotate and thereby the bridging cord 42 (FIGS. 4 and 6) cannot be wound up around the reel 33.

On the other hand, when the bridging cord 42 (FIGS. 4 and 6) is wound up, the cam pin 55 slidably fitted into the small diameter portion of the stepped hole 15*d*1 formed in the projection 15*d* of the third frame body 15 is pushed by a user in the direction of the arrow in FIG. 8 against the force exerted by the compression spring 54. Then, the tapered cam portion 55*a* formed in the cam pin 55 pushes the reel lock cancellation portion 51Rb on the other side of the reel lock lever 51R that has entered the small diameter portion of the stepped hole 15*d*1 and the reel lock lever 51R pivots clockwise around the axis 52R against the force exerted by the torsion spring 53R. The catch 51Ra formed on one side of the reel lock lever 51R is detached from the reel lock notch 33*b*1 formed in the large diameter reel flange portion 33*b* of the winder reel 33, thereby unlocking the winder reel 33. Upon the unlocking of the winder reel 33, the winder reel 33 begins to rotate clockwise by the force exerted by the spiral spring 35 (FIGS. 4 and 6) equipped within the winder reel 33, thereby winding up the bridging cord 42 (FIGS. 4 and 6) around the winder reel 33, since a port for the bridging cord 42 is located as shown in the figures.

When the bridging cord 42 that has once been wound up into the winder reel 33 is again pulled out therefrom, the cam pin 55 is not pushed into the small diameter portion of the stepped hole 15*d*1. At this time, the reel lock lever 51R is biased in a clockwise direction onto the large diameter reel flange 33*b* by the biasing force exerted by the torsion spring 53R. However, the reel lock lever 51R does not prevent the counterclockwise rotation of the winder reel 33 because the reel lock notch 33*b*1 is shaped into a sloped notch so that the reel lock lever 51R can not engage with the reel lock notch 33*b*1 when the winder reel 33 rotates counterclockwise. Therefore, the bridging cord 42 comes out only by pulling the bridging cord 42 out from the winder reel 33.

Figure 9:
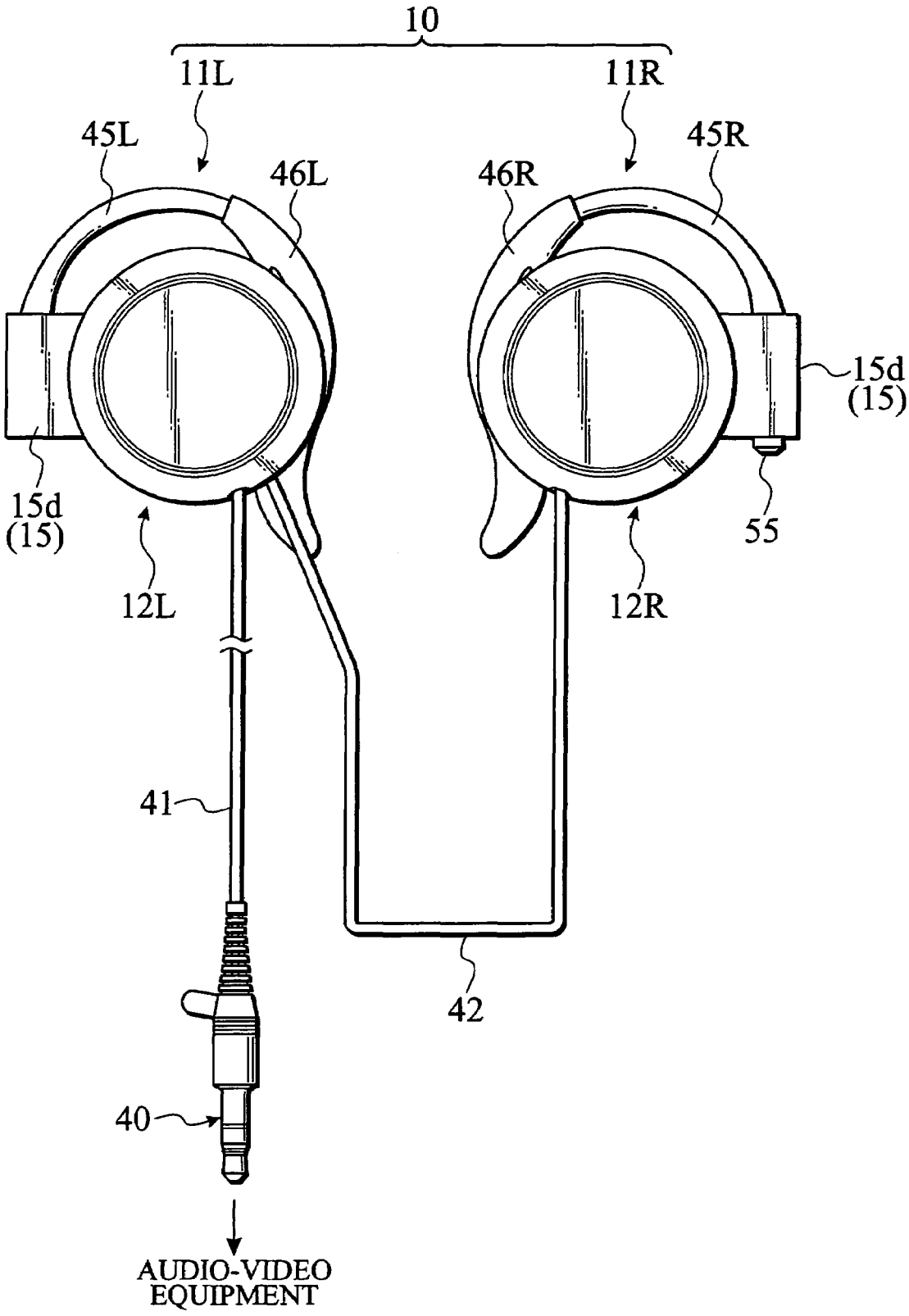
FIG. 9 is an illustration of headphone with cord winder devices according to the first embodiment of the present invention in use, wherein the input and bridging cords are pulled out from a right-and-left pair of headphone housings, respectively.

When the headphone 10 with cord winder devices having the above configuration according to the first embodiment of the present invention is in use, the right-and-left pair of headphone assemblies 11L, 11R are worn on the right-and-left ears of a user with the right-and-left pair of the ear hooks 45L, 45R, respectively, as shown in FIG. 9.

The input cord 41 for connecting to audio-video equipment has been pulled out from the left headphone housing 12L and the input plug 40 thereof is inserted into the audio-video equipment.

On the other hand, the bridging cord 42 for bridging the right and left headphone housings 12R, 12L has been pulled out from the right headphone housing 12R. In this situation, stereo audio signals from the audio-video equipment are received by the left headphone assembly 11L through the input cord 41 and then the left sound is emitted from the small speaker 20 (FIG. 4) accommodated in the left headphone housing 12L, whereas the right audio signals are received by the right headphone assembly 11R through the bridging cord 42 and then the right sound is emitted from the small speaker 20 (FIG. 4) accommodated in the right headphone housing 12R.

Figure 10:
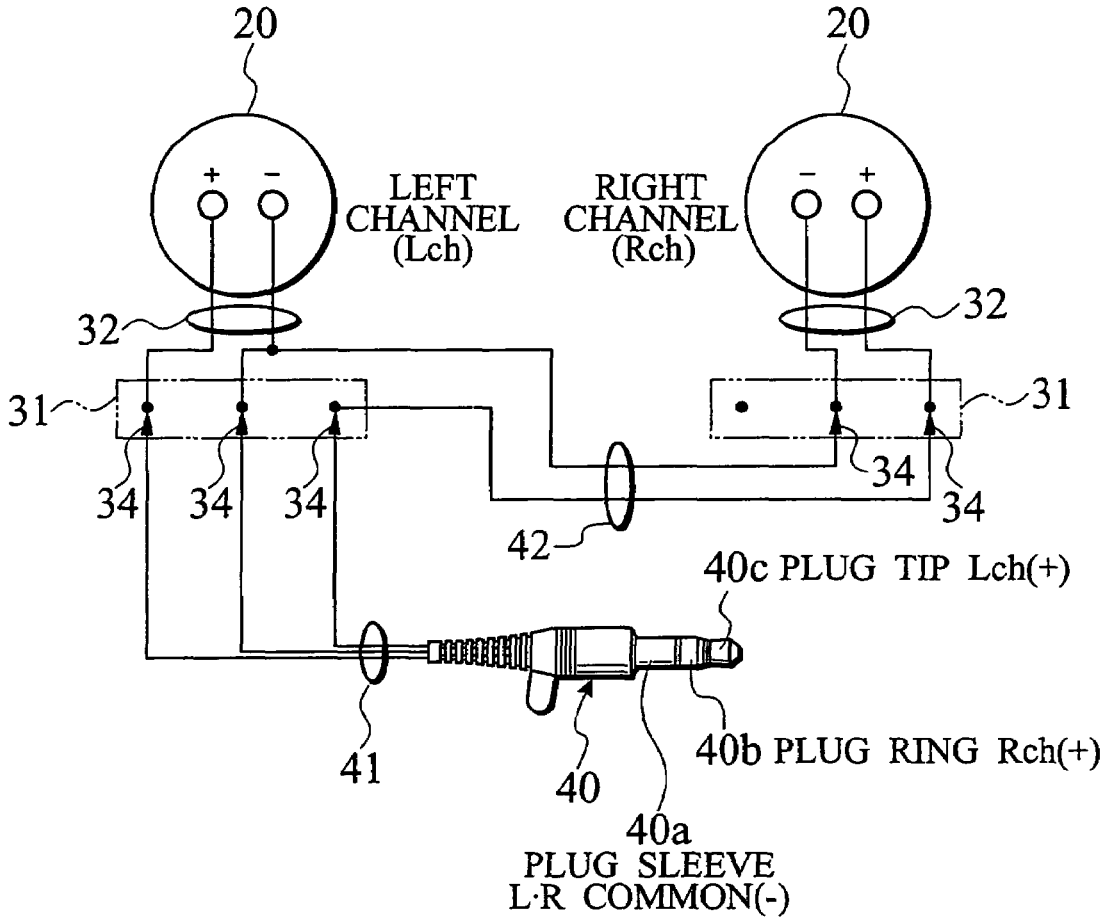
FIG. 10 is an explanatory diagram to show that the small speakers are electrically connected to the input plug via the input and bridging cords.

As shown in FIG. 10, the input plug 40 attached at the distal end of the input cord 41 has the plug sleeve 40*a*, a plug ring 40*b*, and a plug chip 40*c* formed in this order at the end of the molded portion having a diameter of 3.5 mm of the plug 40. The signals (−) common to the right and left sound of the stereo audio signals outputted from the audio-video equipment are received through the plug sleeve 40*a*; the right channel signals Rch (+) are received through the plug ring 40*b*; and the left channel signals Lch (+) are received through the plug chip 40*c*. Then each signal is inputted to the wiring substrate 31 on the left through the input cord 41 and then the three electrically conductive brushes 34 on the left. Next, the left channel signals are inputted to the left small speaker 20 through the wire 32 soldered on the wiring substrate 31 on the left. On the other hand, the right channel signals are inputted to the wiring substrate 31 on the right through the bridging cord 42 and then two electrically conductive brushes 34 on the right. Next, the right channel signals are inputted to the right small speaker 20 through the wire 32 soldered on the wiring substrate 31 on the right.

Figure 11:
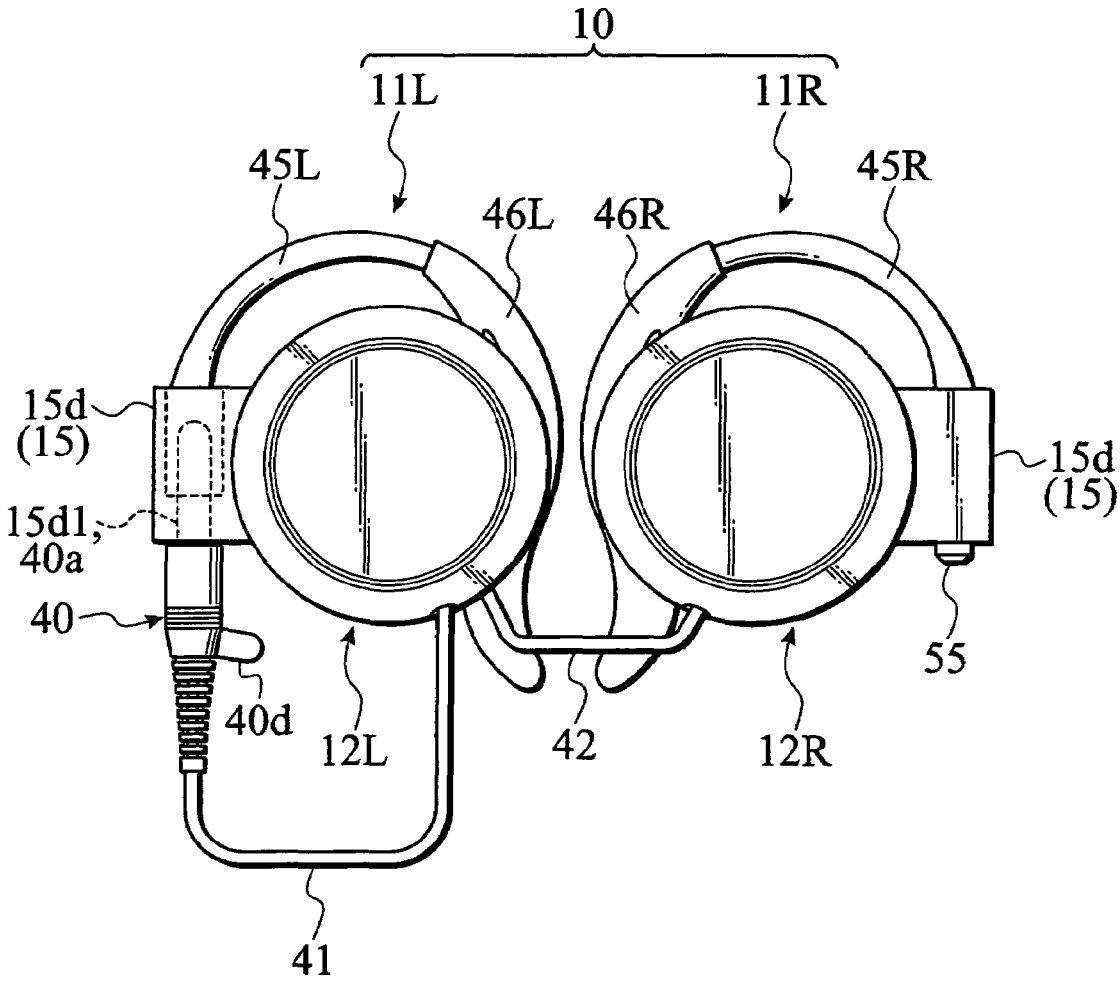
FIG. 11 is a first illustration of headphone with cord winder devices according to the first embodiment of the present invention not in use, wherein the input and bridging cords are wound up into a right-and-left pair of headphone housings, respectively.

As shown in FIG. 11, when the headphone 10 with cord winder devices according to the first embodiment of the present invention is not in use and the input cord 41 is wound up by a manipulation of the plug sleeve 40*a* having a diameter of 3.5 mm, the input cord 41 can be wound up by the cord winder device 30 (FIGS. 4, 6, and 7) accommodated in the left headphone housing 12L by inserting the plug sleeve 40*a* of the input plug 40 into the small diameter portion of the stepped hole 15*d*1 formed inside the projection 15*d* on the third frame body 15 of the left headphone housing 12L.

On the other hand, when the bridging cord 42 is wound up by a manipulation of the cam pin 55 slidably provided within the small diameter portion of the stepped hole 15*d*1 formed inside the projection 15*d* of the third frame body 15 of the right headphone housing 12R, the bridging cord 42 can be wound up by the cord winder device 30 (FIGS. 4, 6, and 8) accommodated in the right headphone housing 12R by pushing the cam pin 55 into the small diameter portion of the stepped hole 15*d*1 formed inside the projection 15*d*.

Figure 12:
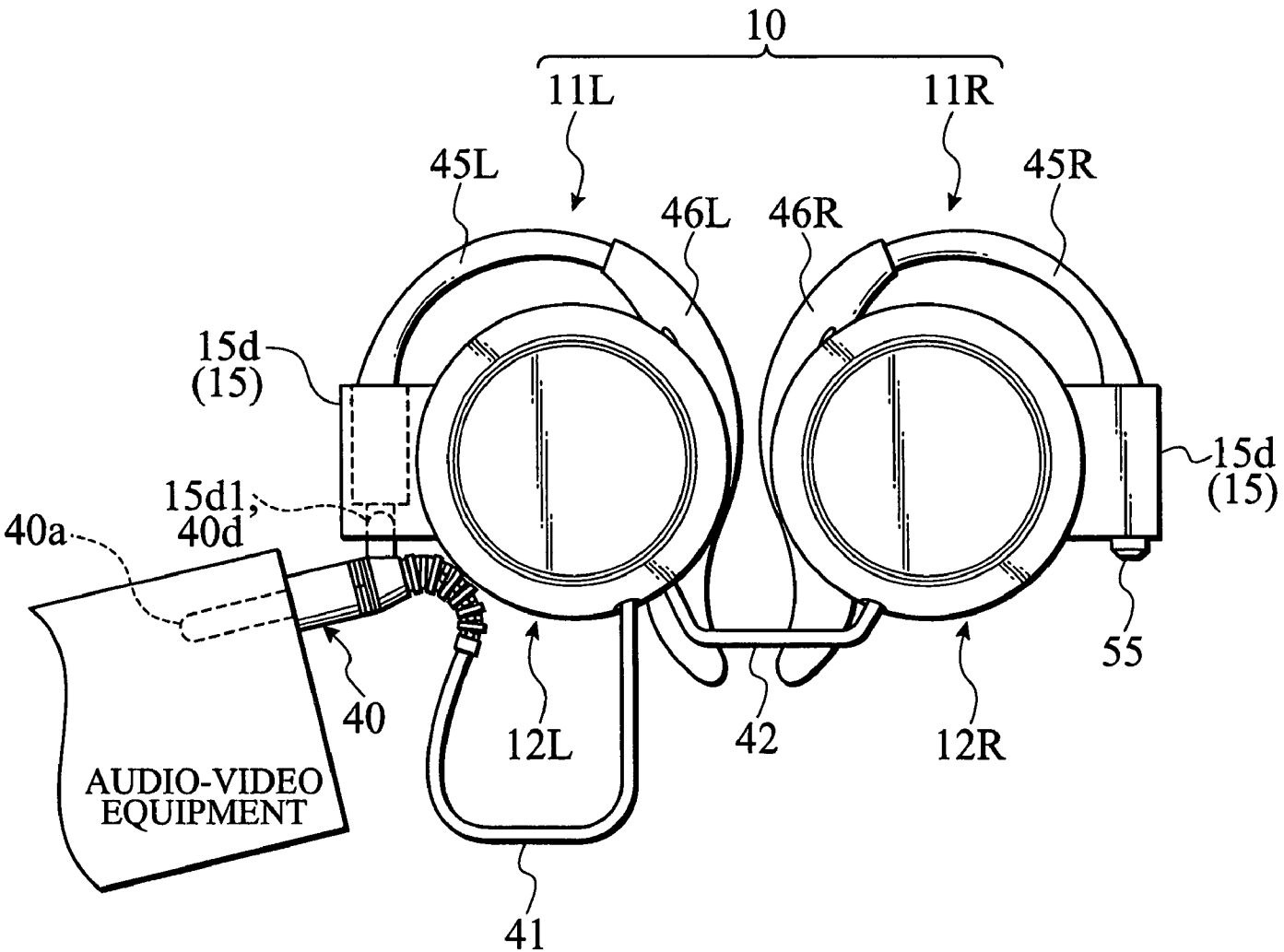
FIG. 12 is a second illustration of headphone with cord winder devices according to the first embodiment of the present invention not in use, wherein the input and bridging cords are wound up into a right-and-left pair of headphone housings, respectively.

Also, as shown in FIG. 12, when the input cord 41 is wound up into the left headphone housing 12L by a manipulation of a salient portion 40*d* protrusively formed on the mold-formed portion of the input plug 40, the portion 40*d* having a diameter of 3.5 mm, the input cord 41 can be wound up by the cord winder device 30 (FIGS. 4, 6, and 7) by inserting the salient portion 40*d* of the input plug 40 into the small diameter portion of the stepped hole 15*d*1 formed inside the projection 15*d* in the third frame body 15 of the left headphone housing 12L, while the plug sleeve 40*a* of the input plug 40 remains inserted into the audio-video equipment.

Nothing to say in this situation, when the bridging cord 42 is wound up into the cord winder device 30 (FIGS. 4, 6, and 8) accommodated inside the right headphone housing 12R of the headphone assembly 11R, the cam pin 55 should be manipulated in the same way explained referring to FIG. 11.

As described above, when the headphone 10 with cord winder devices is not in use, since the input cord 41 and the bridging cord 42 are wound up into the right-and-left pair of cord winder devices 30 accommodated inside the headphone housings 12L, 12R, respectively, the cords 41, 42 are neatly handled and at the same time the headphone 10 can have a fancy appearance. Furthermore, since both the small speaker 20 and the cord winder device 30 are accommodated in each of the right-and-left pair of headphone housings 12L, 12R, the headphone housings 12R, 12L can be commonly used.

Second Embodiment

Figure 13:
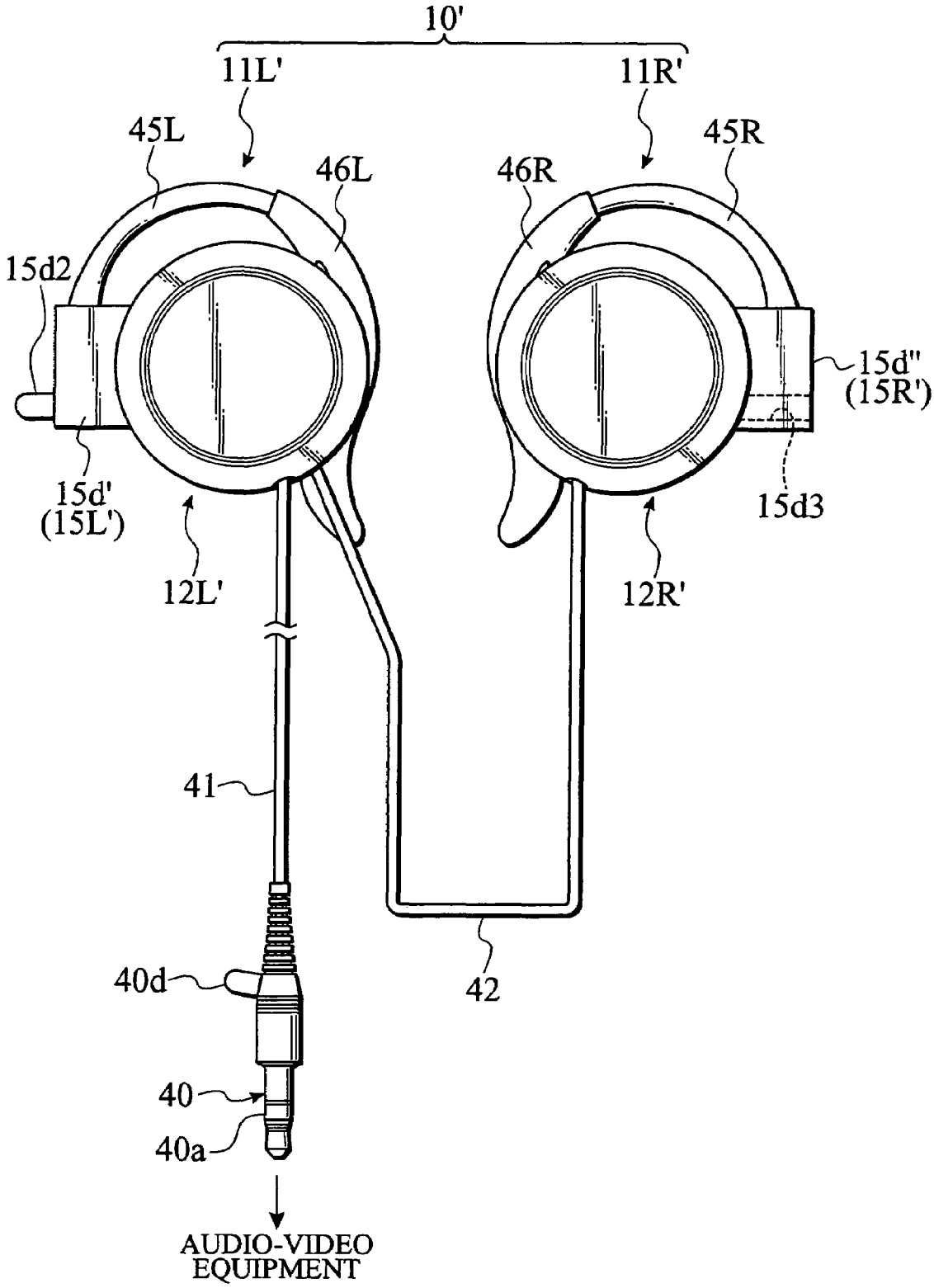
FIG. 13 illustrates a headphone with cord winder devices according to the second embodiment of the present invention, wherein an input cord and a bridging cord are pulled out from the right-and-left pair of the headphone housings.

A headphone 10' with cord winder devices according to a second embodiment of the present invention, shown in FIG. 13, has substantially the same configuration, except for a few differences. In the following, the same reference marks will be used to designate the same and corresponding members and new reference marks will be given to different members from those in the first embodiment, which will be exclusively described below.

The headphone 10' with cord winder devices according to the second embodiment of the present invention is partly an improvement of the headphone 10 with cord winder devices according to the first embodiment of the present invention. In case of the headphone 10 according to the first embodiment, if a user intentionally or accidentally pushes the cam pin 55 provided in the right headphone assembly 11R, as described with reference to FIG. 8, while he or she wears the headphone assemblies 1L, 11R of the headphone 10 with cord winder devices according to the first embodiment, the winder reel 33 that has been locked by the reel locking lever 51R in the right headphone assembly 11R is unlocked, thereby winding up the bridging cord 42. Therefore, there may be problems in that the bridging cord 42 gets caught in the user's neck or the right headphone assembly 11R is removed from the user's right ear due to the winding force exerted on the bridging cord 42.

To resolve the above problem, the headphone 10' with cord winder devices according to the second embodiment is adapted in a way that the reel locking mechanism 50R' provided in the right headphone assembly 11R' can be unlocked and the bridging cord 42 can be wound up into the winder reel 33 provided in the right headphone assembly 11R' only when the headphone assemblies 11L', 11R' are not worn on the user's ears. In addition to this improvement, in the second embodiment, there are additional improvements made in a left third frame body 15L', a right third frame body 15R', and a reel lock lever 51R' of the right reel lock mechanism 50R' in the headphone housing 12L', 12R' of the right-and-left pair of headphone assemblies 11L', 11R'.

By the way, in the second embodiment, the winder reel 33 that has been locked by the reel locking lever 51L of the reel lock mechanism 50L in the left headphone assembly 11L' is unlocked by inserting the plug sleeve 40*a* or the salient portion 40*d* of the input plug 40 into the stepped hole 15*d*1 formed within a projection 15*d*' protrusively formed on the third frame body 15L', in the same way as the headphone 10 according to the first embodiment.

Figure 14:
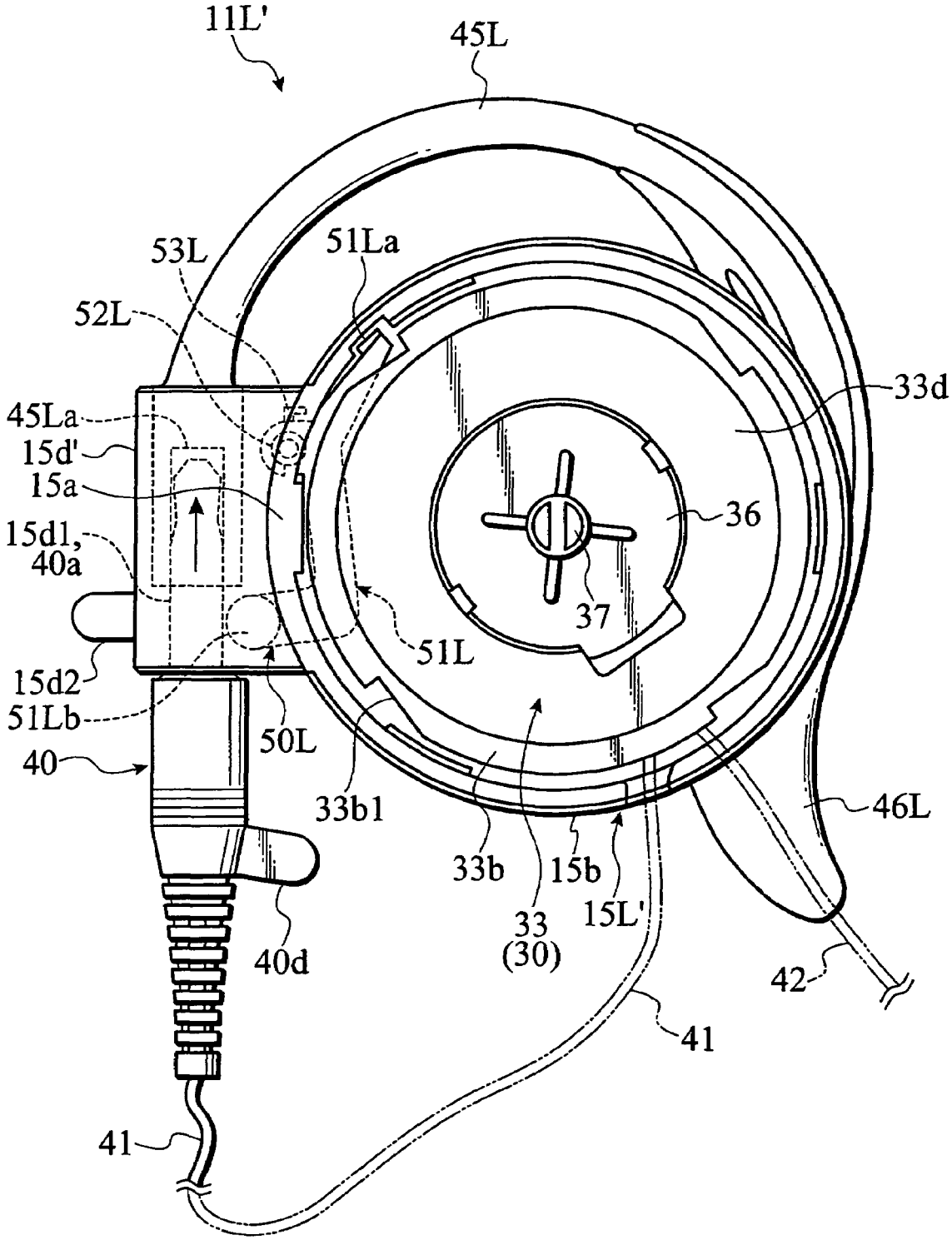
FIG. 14 is a plane view of the left headphone assembly of the headphone with cord winder devices of the second embodiment of the present invention.

Then, the headphone 10' will be described in detail below. As shown in FIGS. 13 and 14, a left headphone assembly 11L' has a extrusion pin 15*d*2 that is integrally formed on the outer surface of the projection 15*d*' formed extending in an arm-like shape from a portion of the outside of ring-shaped circumferential portion 15*b* of the left third frame body 15L'. The extrusion pin 15*d*2 is protrusively formed on a portion of the outside of the projection 15*d*' so as to be substantially perpendicular to the stepped hole 15*d*1 and positioned near the small diameter portion of the stepped hole 15*d*1, into which the plug sleeve 40*a* of the input plug 40 is inserted as shown in close-up in FIG. 14.

Figure 15:
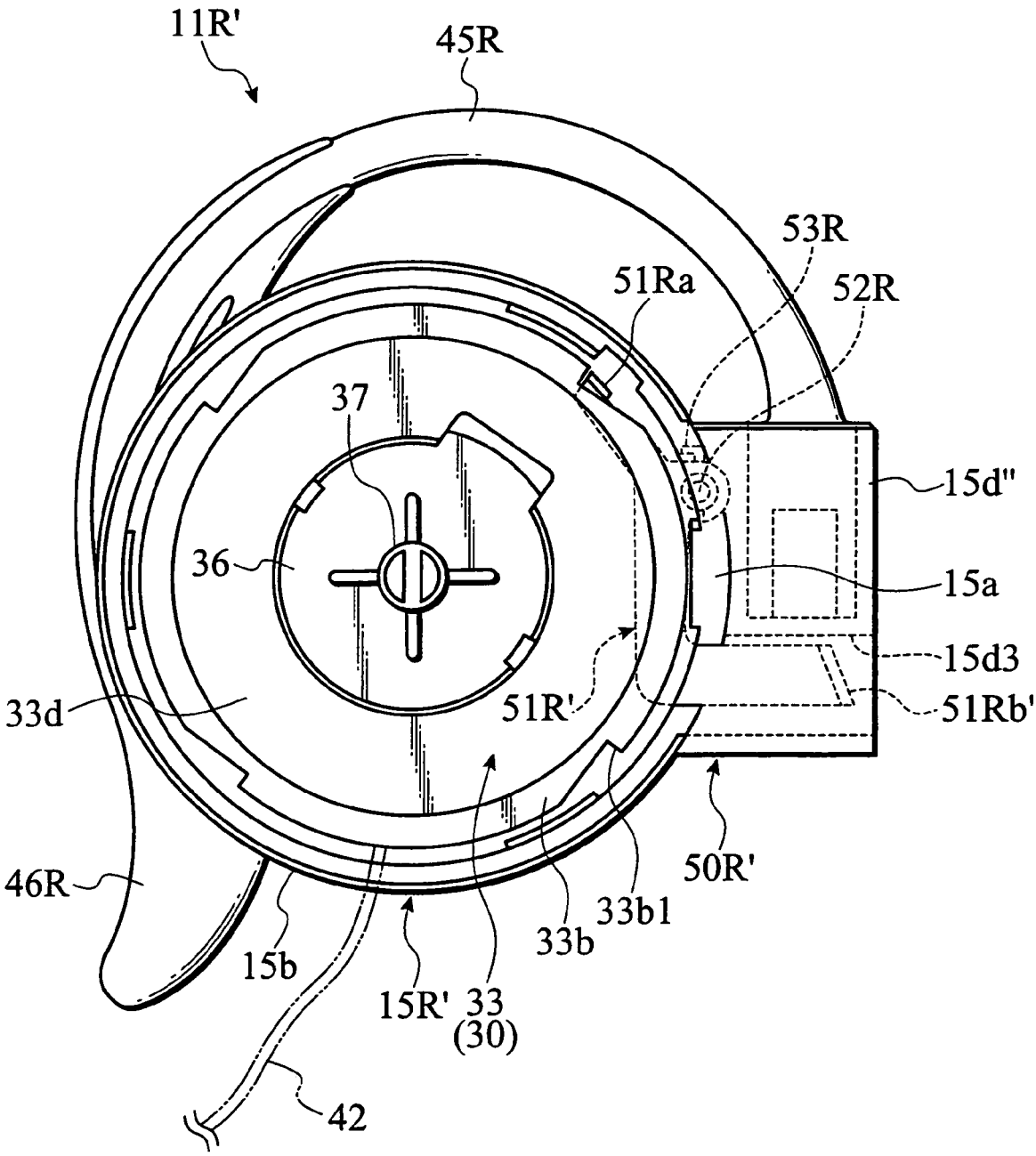
FIG. 15 is a plane view of the right headphone assembly of the headphone with cord winder devices of the second embodiment of the present invention.

On the other hand, as shown in FIGS. 13 and 15, the right headphone assembly 11R' is provided with a reel lock cancellation hole 15*d*3 that is introduced laterally inward into a projection 15*d*" from a portion of the outside thereof, the projection 15*d*" being formed into an arm-like shape extending from a portion of the ring-shaped circumferential portion 15*b* of a third frame body 15R'. The extrusion pin 15*d*2 protrusively formed on the projection 15*d*' of the left third frame body 15L' can be detachably inserted into the reel lock cancellation hole 15*d*3.

On the disk portion 15*a* of the right third frame body 15R' and on the side of the projection 15*d*", there is pivotally provided a right reel lock lever 51R' that is formed of a steel metal material and constantly biased counterclockwise by a torsion spring 53R around an axis 52R implanted in the disk portion 15*a*. The reel lock lever 51R' includes a catch 51Ra formed so as to bend upward on the side of one end and detachable with respect to the reel lock notch 33*b*1 formed on the large diameter reel flange portion 33*b* of the winder reel 33. Also, a reel lock cancellation portion 51Rb' is formed on the opposite side of the reel lock lever 51R' with respect to the axis 52 so as to bend upward, entering a reel lock cancellation hole 15*d*3.

Figure 16:
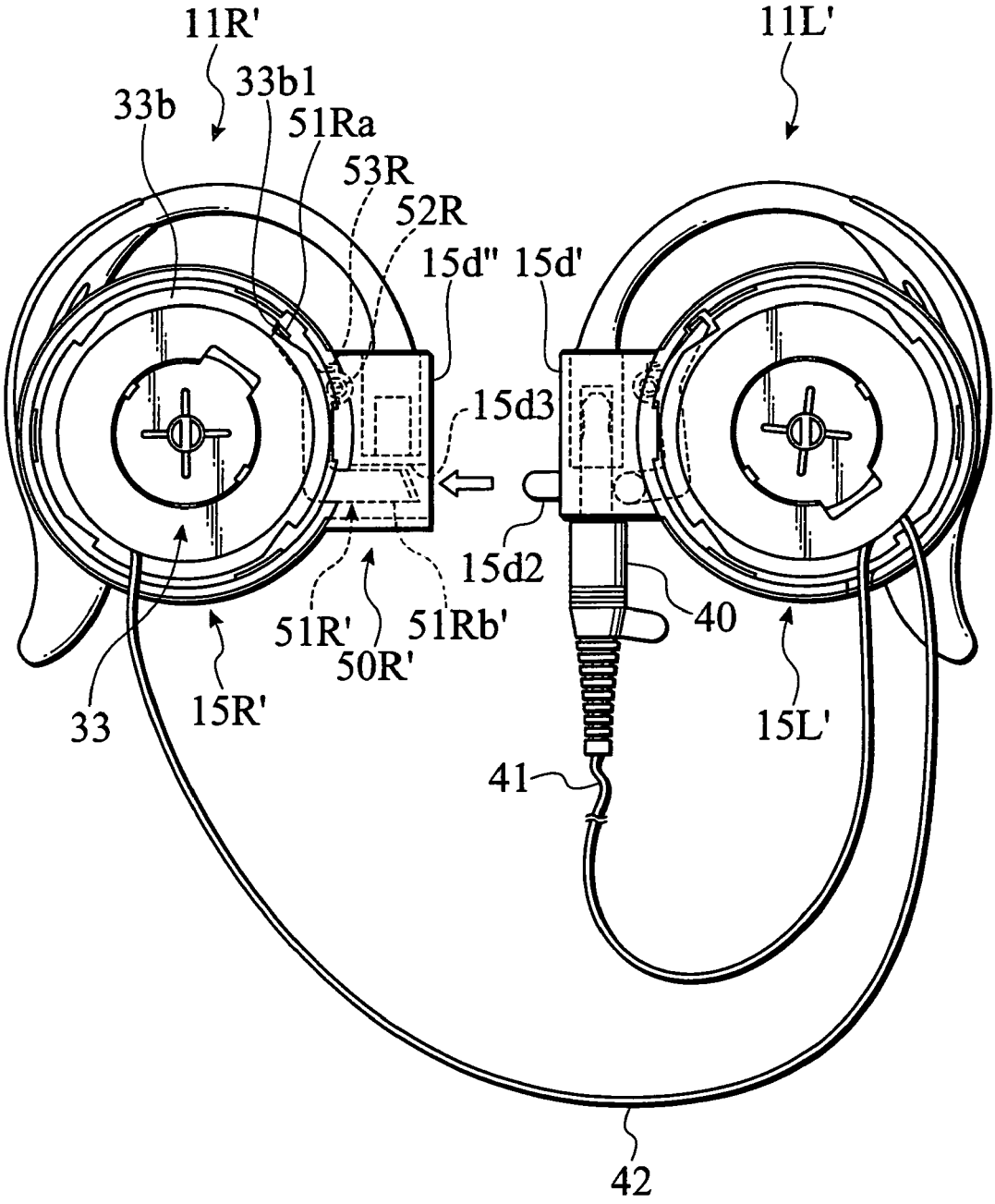
FIG. 16 is an explanatory diagram to describe how a reel lock mechanism in the right headphone assembly is unlocked from the reel lock lever.

When the headphone 10' with cord winder devices configured as above according to the second embodiment is removed from the user's ears and not in use, as shown in FIG. 16, the projection 15*d*' of the third frame body 15L' in the left headphone assembly 11L' and the projection 15*d*" of the third frame body 15R' in the right headphone assembly 11R' are faced with each other. Then, the extrusion pin 15*d*2 protrusively formed on the outer face of the projection 15*d*' of the left third frame body 15L' is inserted into the reel lock cancellation hole 15*d*3 that has been introduced inward from the outer face of the projection 15*d*" of the right third frame body 15R'. Upon the insertion, the extrusion pin 15*d*2 pushes the reel lock cancellation portion 51Rb' of the reel lock lever 51R', the reel lock cancellation portion 51Rb' entering the reel lock cancellation hole 15*d*3. Then, the reel lock lever 51R' pivots clockwise around the axis 52R against the force generated by the torsion spring 53R and thereby the catch 51Ra formed on one side of the reel lock lever 51R' is detached from the reel lock notch 33*b*1 formed on the large diameter reel flange portion 33*b* of the winder reel 33, thereby unlocking the winder reel 33. When the winder reel 33 is unlocked, the winder reel 33 rotates clockwise by the spring force exerted by the spiral spring 35 (FIGS. 4 and 6) mounted inside the winder reel 33, thereby winding up the bridging cord 42 into the winder reel 33.

As explained above, unless the right-and-left headphone assembly 11L', 11R' of the headphone 10' with cord winder devices is removed from the user's ears, the bridging cord 42 can not be wound up into the right headphone assembly 11R', thereby preventing the bridging cord 42 from getting caught around the user's neck or the right headphone assembly 11R from getting removed from the user's right ear by the winding force. Therefore, the safety and usability regarding the headphone 10' with cord winder devices are further improved.

Figure 17:
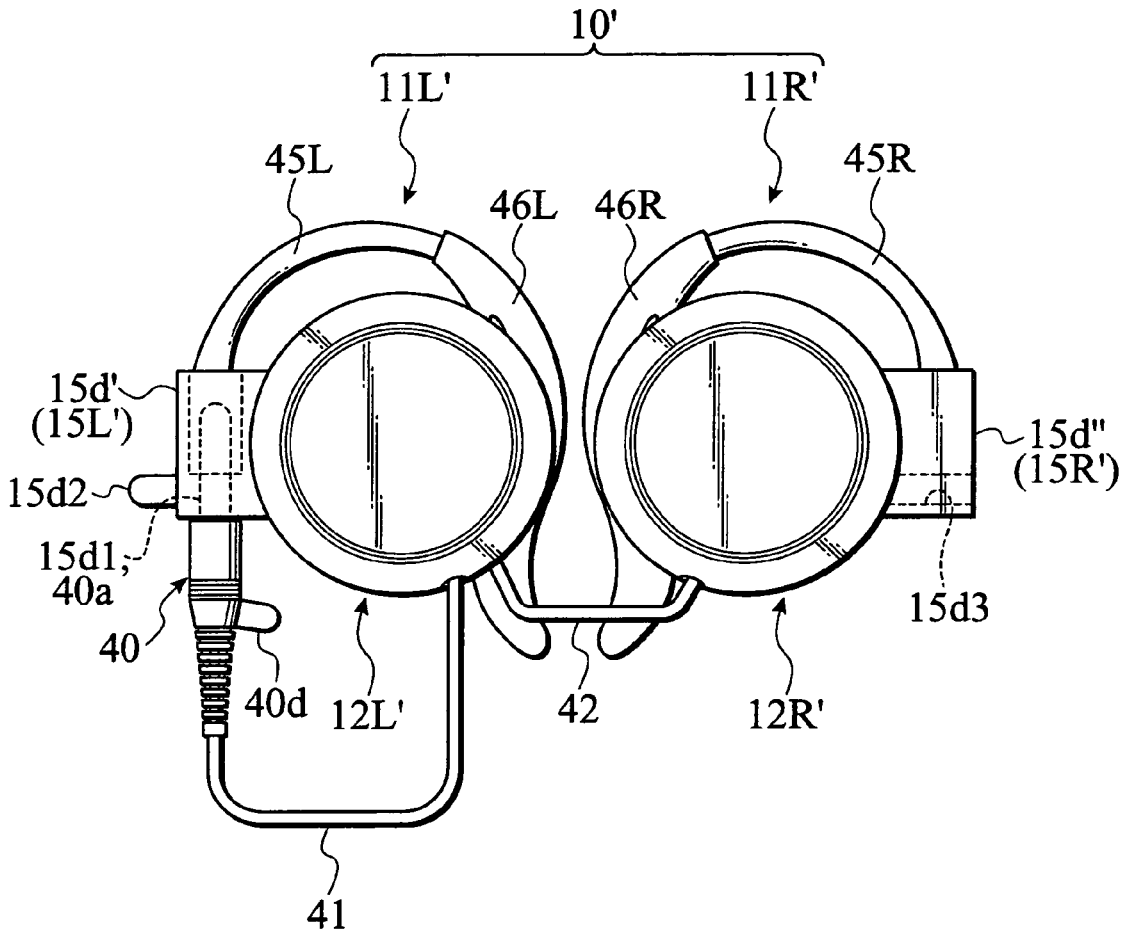
FIG. 17 is an illustration of the headphone with cord winder devices of the second embodiment of the present invention, with the input and bridging cords pulled out during use.
Figure 18:
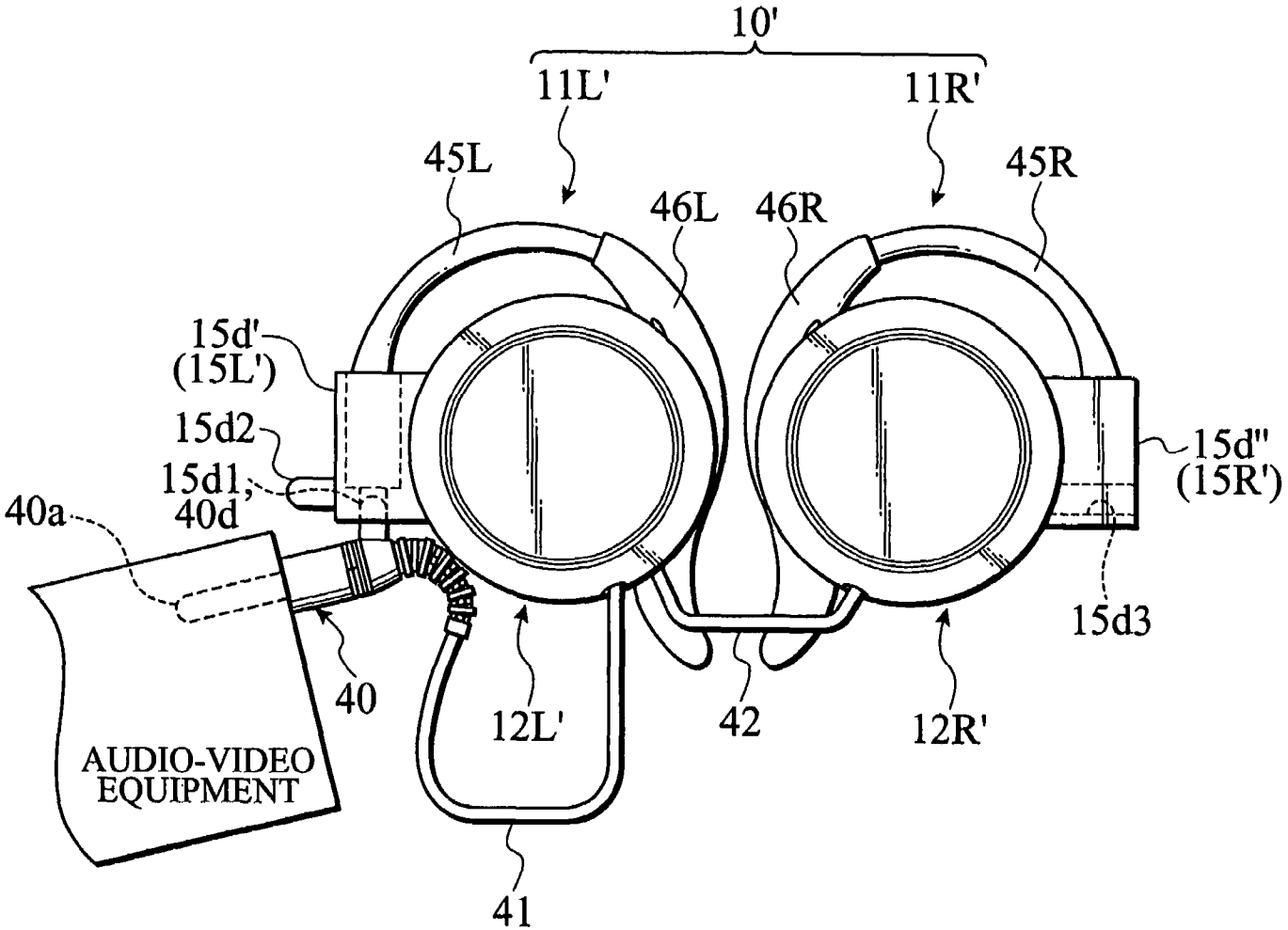
FIG. 18 is an illustration of the headphone with cord winder devices of the second embodiment of the present invention, with the input and bridging cords are wound up into the right-and-left pair of headphone housings.

Also in the case of the headphone 10' with cord winder devices, as shown in FIGS. 17 and 18 in contrast with FIGS. 11 and 12, the input cord 41 can be wound up into the cord winder device 30 (FIGS. 4, 6, and 7) accommodated in the left headphone housing 12L' by accommodating the plug sleeve 40*a* or a salient portion 40*d* of the input plug 40 into the small diameter portion of the stepped hole 15*d*1 formed in the projection 15*d*' of the third frame body 15L' of the left headphone housing 12L'.

On the other hand, the bridging cord 42 can be wound up into the cord winder device 30 (FIGS. 4, 6, and 7) accommodated in the right headphone housing 12R' by inserting the extrusion pin 15*d*2 protrusively formed on the projection 15*d*' of the third frame body 15L' of the left headphone housing 12L' into the reel lock cancellation hole 15*d*3 formed into the projection 15*d*" of the third frame body 15R' of the right headphone housing 12R'.

Additional advantages and modifications will readily occur to those skilled in the art. Therefore, the Invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A headphone comprising:

a first headphone assembly corresponding to one of the left and right ears;

a second headphone assembly corresponding to the other of the left and right ears an input cord for connecting to audio-video equipment; and a bridging cord for bridging the first headphone assembly and the second headphone assembly, wherein the first headphone assembly comprises:

a first speaker, a first cord winder device for winding up the input cord, and a first housing for housing the first speaker and the first cord winder; and wherein the second headphone assembly comprises:

a second speaker, a second cord winder device for winding up the bridging cord, and a second housing for housing the second speaker and the second cord winder.

2. A headphone according to claim 1, further comprising:

a first projection protruding integrally from the exterior of the first headphone housing and having a first hole formed thereinside;

a first reel lock lever that pivots around a first axis and has, on one end thereof, a first catch for locking a first winder reel of the first cord winder device accommodated in the first headphone housing and a first reel lock cancellation portion on the other end thereof with respect to the first axis;

a first torsion spring for biasing the first catch of the first reel lock lever in a direction so as to lock the first winder reel and allowing the first reel lock cancellation portion to enter the first hole formed in the first projection;

a second projection protruding integrally from the exterior of the second headphone housing and having a second hole formed thereinside;

a second reel lock lever that pivots around a second axis and has, on one end thereof, a second catch for locking a second winder reel of the second cord winder device accommodated in the second headphone housing and a second reel lock cancellation portion on the other end thereof with respect to the second axis;

a cam pin that moves forward and backward in the second hole formed in the second projection and has a tapered cam portion for pivoting the second reel lock cancellation portion of the second reel lock lever in a direction so as to unlock the second winder reel;

a compression spring for biasing one end portion of the cam pin to protrude out from the second hole formed in the second projection; and a second torsion spring for biasing the second catch of the second reel lock lever in a direction so as to lock the second winder reel and allowing the second reel lock cancellation portion to enter the vicinity of the tapered cam portion formed in the cam pin in the second hole formed in the second projection;

wherein, when an input plug attached on the distal end of the input cord is inserted into the first hole formed in the first projection, the input plug pushes the first reel lock cancellation portion of the first reel lock lever against the first torsion spring and unlocks an engagement of the first catch onto the first winder reel, thereby winding up the input cord into the first cord winder device accommodated in the first headphone housing, and when the cam pin is pushed into the second hole formed in the second projection against the compression spring, the tapered cam portion formed in the cam pin pushes the second reel lock cancellation portion of the second reel lock lever against the second torsion spring and unlocks an engagement of the second catch onto the second winder reel, thereby winding up the bridging cord into the second cord winder device accommodated in the second headphone housing.

3. A headphone according to claim 1, further comprising:

a first projection protruding integrally from the exterior of the first headphone housing, having a first extrusion pin formed protrusively from the exterior surface thereof and a first hole formed thereinside;

a first reel lock lever that pivots around a first axis and has, on one end thereof, a first catch for locking a first winder reel of the first cord winder device accommodated in the first headphone housing and a first reel lock cancellation portion on the other end thereof with respect to the first axis;

a first torsion spring for biasing the first catch of the first reel lock lever in a direction so as to lock the first winder reel and allowing the first reel lock cancellation portion to enter the first hole formed in the first projection;

a second projection protruding integrally from the exterior of the second headphone housing and having a second hole formed thereinside;

a second reel lock lever that pivots around a second axis and has, on one end thereof, a second catch for locking a second winder reel of the second cord winder device accommodated in the second headphone housing and a second reel lock cancellation portion on the other end thereof with respect to the second axis;

a second torsion spring for biasing the second catch of the second reel lock lever in a direction so as to lock the second winder reel and allowing the second reel lock cancellation portion to enter the second hole formed in the second projection, wherein, when an input plug attached on the distal end of the input cord is inserted into the first hole formed in the first projection, the input plug pushes the first reel lock cancellation portion of the first reel lock lever against the first torsion spring and unlocks an engagement of the first catch onto the first winder reel, thereby winding up the input cord into the first cord winder device accommodated in the first headphone housing, and when the first extrusion pin formed protrusively from the exterior surface of the first projection is inserted into the second hole formed in the second projection, the first extrusion pin pushes the second reel lock cancellation portion of the second reel lock lever against the second torsion spring and unlocks an engagement of the second catch onto the second winder reel, thereby winding up the bridging cord into the second cord winder device accommodated in the second headphone housing.

4. A headphone according to claim 2, wherein when the input cord is wound up into the first headphone housing, a plug sleeve formed to have a predetermined diameter at the front edge of the input plug or a salient portion protrusively formed to have a predetermined diameter on the mold-formed portion of the input plug is inserted into the first hole formed in the first projection.

5. A headphone according to claim 3, wherein when the input cord is wound up into the first headphone housing, a plug sleeve formed to have a predetermined diameter at the front edge of the input plug or a salient portion protrusively formed to have a predetermined diameter on the mold-formed portion of the input plug is inserted into the first hole formed in the first projection.

* * * * *